US012415692B2

(12) United States Patent
Shimosaka et al.

(10) Patent No.: US 12,415,692 B2
(45) Date of Patent: Sep. 16, 2025

(54) MEDIUM CONVEYANCE DEVICE

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/568,746

(22) PCT Filed: Jun. 15, 2021

(86) PCT No.: PCT/JP2021/022726
§ 371 (c)(1),
(2) Date: Dec. 8, 2023

(87) PCT Pub. No.: WO2022/264278
PCT Pub. Date: Dec. 22, 2022

(65) Prior Publication Data

US 2024/0262643 A1 Aug. 8, 2024

(51) Int. Cl.
*B65H 3/52* (2006.01)
*B65H 3/06* (2006.01)
(Continued)

(52) U.S. Cl.
CPC . *B65H 3/0638* (2013.01); *B65H 2404/13161* (2013.01); *B65H 2404/13163* (2013.01); *B65H 2801/12* (2013.01)

(58) Field of Classification Search
CPC ..... B65H 3/68; B65H 3/66; B65H 3/0638; B65H 3/5276; B65H 3/5284; B65H 3/56;
(Continued)

(56) References Cited

U.S. PATENT DOCUMENTS

2006/0097441 A1* 5/2006 Shikan ..... B65H 1/24 271/118
2008/0203652 A1* 8/2008 Yasukawa ..... B65H 3/063 271/117
(Continued)

FOREIGN PATENT DOCUMENTS

JP H02-305741 A 12/1990
JP 06179538 A * 6/1994
(Continued)

OTHER PUBLICATIONS

International Search Report dated Aug. 3, 2021 for corresponding PCT Application No. PCT/JP2021/022726 (3 pages) with English Translation (2 pages).
(Continued)

*Primary Examiner* — Luis A Gonzalez
(74) *Attorney, Agent, or Firm* — WOMBLE BOND DICKINSON (US) LLP

(57) ABSTRACT

Provided is a medium conveying apparatus to enable suitable feeding of a plurality of types of media. A medium conveying apparatus includes a guide member including an opening or a notch and configured to form a conveyance surface of a medium, a feed roller located inside the opening or the notch and configured to feed the medium, a separation roller located to face the feed roller, and protruding parts located on left and right sides of the separation roller relative to a medium conveying direction. The guide member includes recessed parts positioned on left and right sides of the feed roller relative to the medium conveying direction. The protruding parts are located at positions facing the opening or the notch, or the recessed parts in such a way that the medium is conveyed between the protruding parts and the recessed parts. A tip of each of the protruding parts is
(Continued)

positioned on the feed roller side of a nip part of the feed roller and the separation roller.

11 Claims, 25 Drawing Sheets

(51) Int. Cl.
*B65H 3/54* (2006.01)
*B65H 3/66* (2006.01)

(58) Field of Classification Search
CPC ... B65H 3/565; B65H 3/54; B65H 2301/5122
See application file for complete search history.

(56) References Cited

U.S. PATENT DOCUMENTS

2013/0328261 A1* 12/2013 Cheng ..... B65H 3/56 271/18
2014/0131939 A1* 5/2014 Shih ..... B65H 3/0653 271/126
2014/0203494 A1* 7/2014 Okumura ..... B65H 3/56 271/18
2018/0179006 A1 6/2018 Kogi et al.
2020/0071100 A1* 3/2020 Namiki ..... B65H 7/02
2021/0099592 A1* 4/2021 Nishimura ..... H04N 1/00665
2021/0155439 A1* 5/2021 Namiki ..... B65H 7/125

FOREIGN PATENT DOCUMENTS

JP H06-179540 A 6/1994
JP 2007-076875 A 3/2007
JP 2016-179872 A 10/2016
JP 2018-108871 A 7/2018

OTHER PUBLICATIONS

Written Opinion dated Aug. 3, 2021 for corresponding PCT Application No. PCT/JP2021/022726 (3 pages) with English Translation (3 pages).
Preliminary Report on Patentability dated Dec. 14, 2023 for corresponding PCT Application No. PCT/JP2021/022726 (4 pages) with English Translation (4 pages).
Japanese Office Action dated Feb. 18, 2025 regarding Japanese Patent Application No. 2024-096177 corresponding to U.S. Appl. No. 18/568,746 (3 pages) with English Translation (6 pages).
Japanese Office Action dated Jul. 8, 2025 regarding Japanese Patent Application No. 2024-096177 corresponding to U.S. Appl. No. 18/568,746 (3 pages) with English Translation (5 pages).

* cited by examiner

MEDIUM CONVEYANCE DEVICE

CROSS-REFERENCE TO RELATED APPLICATION(S)

This application is a U.S. National Phase Patent Application and claims priority to and the benefit of International Application Number PCT/JP2021/022726, filed on Jun. 15, 2021 the entire content of which is incorporated herein by reference.

TECHNICAL FIELD

The present disclosure relates to a medium conveying apparatus and particularly relates to a medium conveying apparatus including a feed roller and a separation roller, a control method, and a control program.

BACKGROUND ART

In recent years, it is preferred that a medium conveying apparatus to convey and image a plurality of media while separating the media, such as a scanner, convey not only common plain paper copier (PPC) paper but also various types of media, such as thin paper, an envelope, and bound carbon paper. Thin paper is likely to include a wrinkle or a tear and further is soft, and therefore when thin paper is conveyed as a medium, jamming of the medium due to occurrence of buckling of the medium is likely to occur. When a medium composed of a plurality of sheets of paper, such as an envelope or carbon paper, is conveyed, jamming of the medium may occur due to exertion of a separating force on the medium. A medium conveying apparatus generally has a separation mode of separating and feeding a medium and a non-separation mode of feeding a medium without separation as a feed mode. For example, by setting the feed mode of the medium conveying apparatus to the non-separation mode, occurrence of jamming of a medium is prevented; however, a user feels troublesomeness of having to change the feed mode for each medium type, which impairs user convenience. Further, when a plurality of types of media are collectively set in a loading tray and are sequentially conveyed, it is difficult to change the feed mode for each medium type.

A paper feeding apparatus including a paper feeding means for separating and feeding paper one sheet, assuming that the paper has a convexly curled state is disclosed (see PTL 1). The paper feeding apparatus includes a turn guide to reverse separated and fed paper in a convex direction and a guiding member provided between the turn guide and the paper feeding means, to guide paper reversed in the convex direction while adjusting the paper to a curled state in a direction opposite to the convex direction.

A paper feeding-conveyance apparatus including a paper feeding means, a conveyance roller pair to convey paper fed from the paper feeding means, and a lower paper feeding guide installed between the paper feeding means and the conveyance roller pair is disclosed (see PTL 2). The lower paper feeding guide includes a part where paper guide surfaces on both ends are higher than a guide surface in the central part.

CITATION LIST

Patent Literature

[PTL 1]
Japanese Unexamined Patent Publication (Kokai) No. H6-179540
[PTL 2]
Japanese Unexamined Patent Publication (Kokai) No. H2-305741

SUMMARY OF INVENTION

It is preferred that a medium conveying apparatus suitably feed a plurality of types of media.

An object of a medium conveying apparatus is to enable suitable feeding of a plurality of types of media.

According to some embodiments, a medium conveying apparatus includes a guide member including an opening or a notch and configured to form a conveyance surface of a medium, a feed roller located inside the opening or the notch and configured to feed the medium, a separation roller located to face the feed roller, and protruding parts located on left and right sides of the separation roller relative to a medium conveying direction. The guide member includes recessed parts positioned on left and right sides of the feed roller relative to the medium conveying direction. The protruding parts are located at positions facing the opening or the notch, or the recessed parts in such a way that the medium is conveyed between the protruding parts and the recessed parts. A tip of each of the protruding parts is positioned on the feed roller side of a nip part of the feed roller and the separation roller.

The medium conveying apparatus according to the present embodiment can suitably feed a plurality of types of media.

The object and advantages of the invention will be realized and attained by means of the elements and combinations, in particular, described in the claims. It is to be understood that both the foregoing general description and the following detailed description are exemplary and explanatory, and are not restrictive of the invention as claimed.

DESCRIPTION OF EMBODIMENTS

Hereinafter, a medium conveying apparatus, a control method and a control program according to an embodiment, will be described with reference to the drawings. However, it should be noted that the technical scope of the invention is not limited to these embodiments, and extends to the inventions described in the claims and their equivalents.

Figure 1:
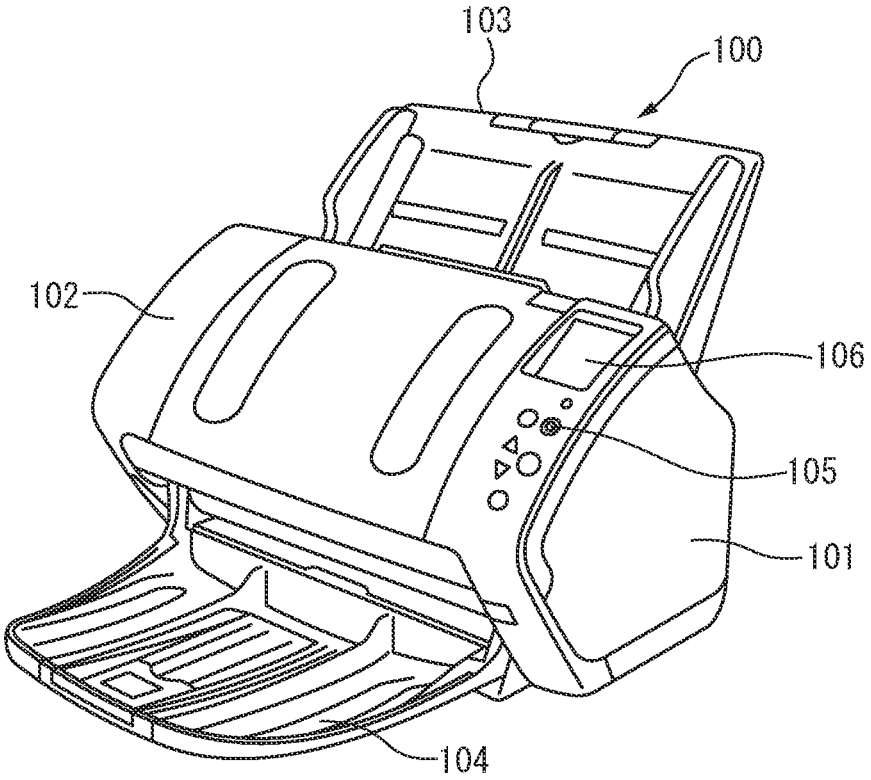
FIG. 1 is a perspective view illustrating an example of a medium conveying apparatus according to an embodiment.

FIG. 1 is a perspective view illustrating an example of a medium conveying apparatus configured as an image scanner. The medium conveying apparatus 100 conveys and images a medium being a document. For example, a medium is paper, thin paper, thick paper, a card, carbon paper, or an envelope. Carbon paper is a medium acquired by binding a plurality of sheets of thin paper, such as non-carbon paper. The medium conveying apparatus 100 may be a facsimile, a copying machine, a multifunctional peripheral (MFP), etc. A conveyed medium may be an object being printed on, etc., instead of a document, and the medium conveying apparatus 100 may be a printer, etc.

The medium conveying apparatus 100 includes a lower housing 101, an upper housing 102, a loading tray 103, an ejection tray 104, an operation device 105, a display device 106, etc.

The upper housing 102 is located at a position covering the top surface of the medium conveying apparatus 100 and is engaged with the lower housing 101 by a hinge in such a way as to be openable when, for example, a medium is stuck or cleaning of the inside of the medium conveying apparatus 100 is performed.

The loading tray 103 is engaged with the lower housing 101 and places a medium to be fed and conveyed. The ejection tray 104 is engaged with the upper housing 102 and places an ejected medium. The ejection tray 104 may be engaged with the lower housing 101.

The operation device 105 includes an input device such as a button, and an interface circuit acquiring a signal from the input device, accepts an input operation by a user, and outputs an operation signal based on the input operation by the user. The display device 106 includes a display including a liquid crystal, an organic electro-luminescence (EL), etc., and an interface circuit outputting image data to the display, and displays the image data on the display.

Figure 2:
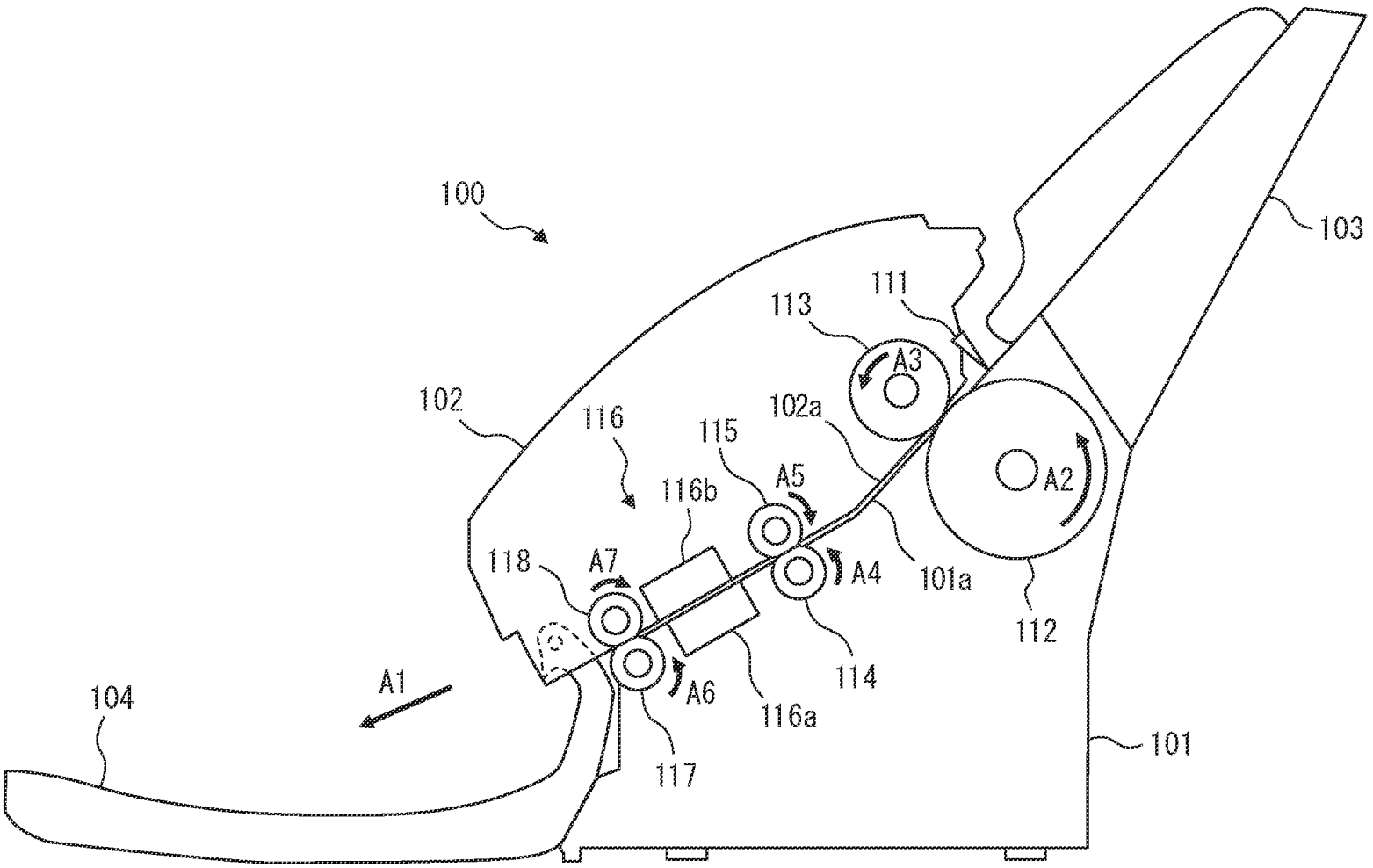
FIG. 2 is a diagram for illustrating a conveyance path inside the medium conveying apparatus.

FIG. 2 is a diagram for illustrating a conveyance path inside the medium conveying apparatus.

The conveyance path inside the medium conveying apparatus 100 includes a medium sensor 111, a feed roller 112, a separation roller 113, a first conveyance roller 114, a second conveyance roller 115, an imaging device 116, a first ejection roller 117, a second ejection roller 118, etc.

Each of the numbers of the feed roller 112, the separation roller 113, the first conveyance roller 114, the second conveyance roller 115, the first ejection roller 117, and/or the second ejection roller 118 is not limited to one and may be more than one. In that case, a plurality of feed rollers 112, separation rollers 113, first conveyance rollers 114, second conveyance rollers 115, first ejection rollers 117, and/or second ejection rollers 118 are respectively spaced in the width direction A2 perpendicular to a medium conveying direction.

The top surface of the lower housing 101 forms a lower guide 101*a* of the conveyance path of a medium, and the bottom surface of the upper housing 102 forms an upper guide 102*a* of the conveyance path of a medium. An arrow A1 in FIG. 2 indicates a medium conveying direction. Hereinafter, an upper stream refers to an upper stream in the medium conveying direction A1, and a lower stream refers to a lower stream in the medium conveying direction A1.

The medium sensor 111 is located on the upstream side of the feed roller 112 and the separation roller 113. The medium sensor 111 includes a contact detection sensor and detects whether a medium is placed in the loading tray 103. The medium sensor 111 generates and outputs a first medium signal the signal value of which varies between a state in which a medium is placed in the loading tray 103 and a state in which a medium is not placed. The medium sensor 111 is not limited to a contact detection sensor and any other sensor that can detect existence of a medium, such as a light detection sensor, may be used as the medium sensor 111.

The feed roller 112 is provided in the lower housing 101, sequentially separates media placed in the loading tray 103 from the lower side, and feeds the media. The separation roller 113 is a so-called brake roller or retard roller, is provided in the upper housing 102 to face the feed roller 114, and rotates in a direction opposite to the medium feeding direction. The feed roller 112 may be provided in the upper housing 102, the separation roller 113 may be provided in the lower housing 102, and the feed roller 112 may sequentially separates media placed in the loading tray 103 from the upper side.

The first conveyance roller 114 and the second conveyance roller 115 are located on the downstream side of the feed roller 112 to face each other and convey a medium fed by the feed roller 112 and the separation roller 113 to the imaging device 116. The first conveyance roller 114 is provided in the lower housing 101, and the second conveyance roller 115 is provided in the upper housing 102 and above the first conveyance roller 114.

The imaging device 116 is located on the downstream side of the first conveyance roller 114 and images a medium conveyed by the first conveyance roller 114. The imaging device 116 includes a first imaging device 116*a* and a second imaging device 116*b* that are located to face each other with the medium conveyance path in between. The first imaging device 116*a* includes a line sensor based on a unity-magnification optical system type contact image sensor (CIS) including complementary metal oxide semiconductor-(CMOS-) based imaging elements linearly arranged in a main scanning direction. The first imaging device 118*a* further includes lenses each forming an image on an imaging element, and an A/D converter amplifying and analog-digital (A/D) converting an electric signal output from the imaging element. The first imaging device 116*a* generates an input image by imaging the front side of a conveyed medium in accordance with control from a processing circuit to be described later and outputs the generated image.

Similarly, the second imaging device 116*b* includes a line sensor based on a unity-magnification optical system type CIS including CMOS-based imaging elements linearly arranged in the main scanning direction. The second imaging device 116*b* further includes lenses each forming an image on an imaging element, and an A/D converter amplifying and analog-digital (A/D) converting an electric signal output from the imaging element. The second imaging device 116*b* generates an input image by imaging the back side of a conveyed medium in accordance with control from the processing circuit to be described later and outputs the generated image.

Only one of the first imaging device 116*a* and the second imaging device 116*b* may be located and only one side of a medium may be read in the medium conveying apparatus 100. Further, a line sensor based on a unity-magnification optical system type CIS including charge coupled device-(CCD-) based imaging elements may be used in place of the line sensor based on a unity-magnification optical system type CIS including CMOS-based imaging elements. Further, a reduction optical system type line sensor including CMOS-based or CCD-based imaging elements may be used.

The first ejection roller 117 and the second ejection roller 118 are located on the downstream side of the imaging device 116 to face each other and eject a medium conveyed by the first conveyance roller 114 and the second conveyance roller 115 and imaged by the imaging device 116 into the ejection tray 104. The first ejection roller 117 is provided in the lower housing 101, and the second ejection roller 118 is provided in the upper housing 102 and above the first ejection roller 119.

A medium placed in the loading tray 103 is conveyed between the lower guide 101*a* and the upper guide 102*a* toward the medium conveying direction A1 by the feed roller 112 rotating in a direction of an arrow A2 in FIG. 2, i.e., the medium feeding direction. As a feed mode, the medium conveying apparatus 100 has a separation mode of separating and feeding a medium and a non-separation mode of feeding a medium without separation. The feed mode is set by a user by using the operation device 105 or an information processing apparatus connected to the medium conveying apparatus 100 by communication. When the feed mode is set to the separation mode, the separation roller 113 rotates in a direction of an arrow A3, i.e., a direction opposite to the medium feeding direction at the time of medium feeding. When a plurality of media are placed in the loading tray 103, only a medium in contact with the feed roller 112 out of the medium placed in the loading tray 103 is separated by working of the feed roller 112 and the separation roller 115. Consequently, conveyance of a medium other than the separated medium is restricted (prevention of multi feed). On the other hand, when the feed mode is set to the non-separation mode, the separation roller 113 rotates in a direction opposite to the arrow A3, i.e., the medium feeding direction.

A medium is fed between the first conveyance roller 114 and the second conveyance roller 115 while being guided by the lower guide 101*a* and the upper guide 102*a*. The medium is fed between the first imaging device 116*a* and the second imaging device 116*b* by the first conveyance roller 114 and the second conveyance roller 115 rotating in directions of an arrow A4 and an arrow A5, respectively. The medium read by the imaging device 116 is ejected into the ejection tray 104 by the first ejection roller 117 and the second ejection roller 118 rotating in directions of an arrow A6 and an arrow A7, respectively.

Figure 3:
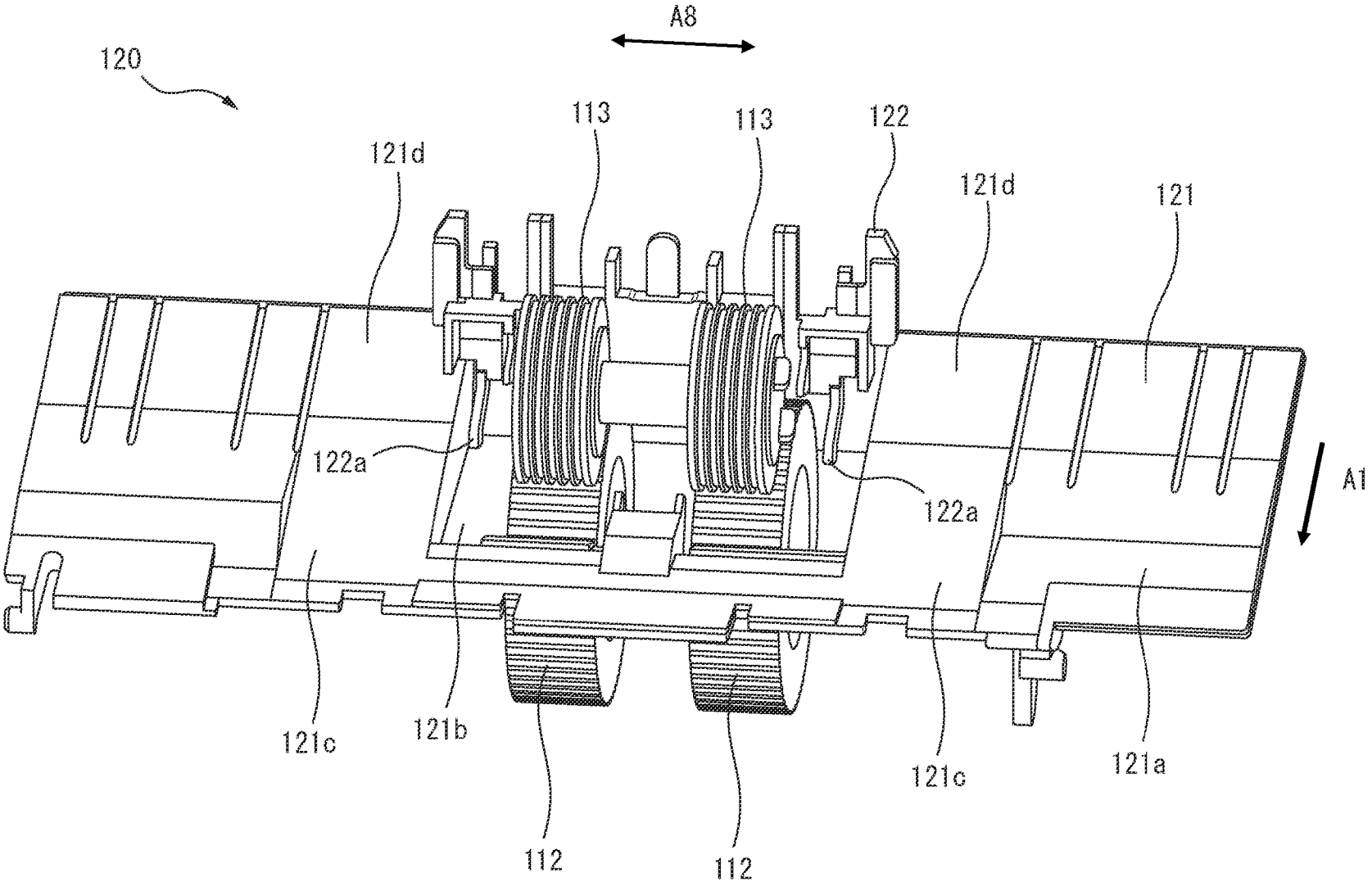
FIG. 3 is a schematic diagram for illustrating an example of feeding mechanism.

FIG. 3 is a schematic diagram for illustrating an example of a feeding mechanism in the medium conveying apparatus.

As illustrated in FIG. 3, the medium conveying apparatus 100 includes a guide member 121 and a feed arm 122 in addition to the feed roller 112 and the separation roller 113 as the feeding mechanism 120. In the example illustrated in FIG. 3, the medium conveying apparatus 100 includes two each of the feed rollers 112 and the separation rollers 113.

The guide member 121 is a plate-shaped member, is provided on the top surface of the lower housing 101 to form a conveyance surface 121*a* of a medium and forms part of the lower guide 101*a*. The guide member 121 has an opening 121*b* in the central part in the width direction A2 perpendicular to the medium conveying direction, and the feed roller 112 is located in the opening 121*b*.

The conveyance surface 121*a* of the guide member 121 includes recessed parts 121*c* positioned on the left and right sides of the feed roller 112 relative to the medium conveying direction A1. In the example illustrated in FIG. 3, the guide member 121 includes two recessed parts 121*c*. The recessed part 121*c* is formed in such a way that the downstream side of the recessed part 121*c* is inclined downward relative to a region 121*d* in the conveyance surface 121*a* on the upstream side of the recessed part 121*c*

The feed arm 122 is provided in the upper housing 102 and is located on the upstream side of the separation roller 113 and in the neighborhood of the separation roller 113. The feed arm 122 includes protruding parts 122*a* extending from the upper housing 102 side to the lower housing 101 side, i.e., from the separation roller 113 side to the feed roller 112 side. The protruding parts 122*a* are located on the left and right sides of the separation roller 113 relative to the medium conveying direction A1. In particular, the protruding parts 122*a* are located at positions facing the opening 121*b* of the guide member 121. In the example illustrated in FIG. 3, the feed arm 122 includes two protruding parts 122*a*.

Figure 4:
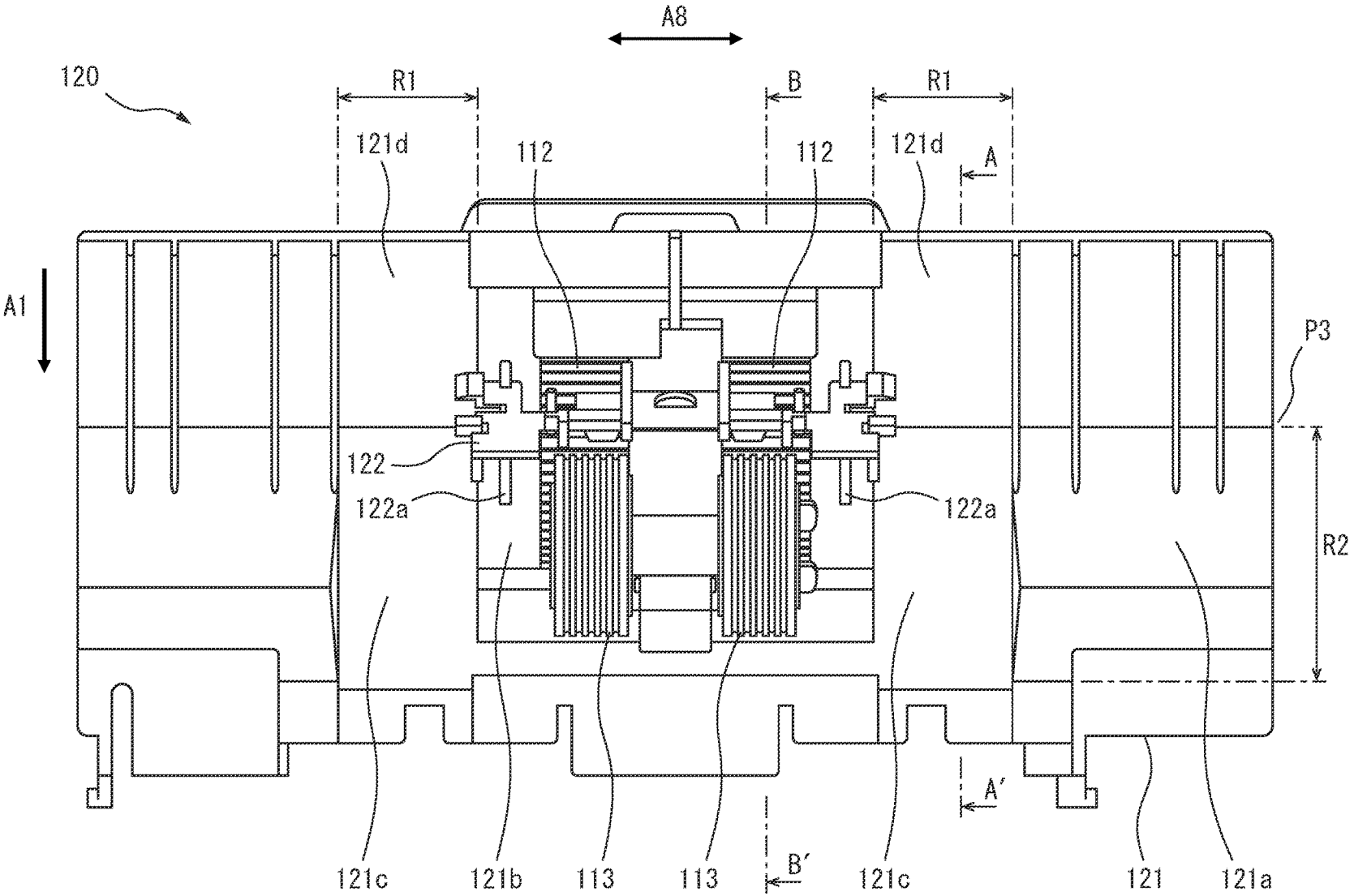
FIG. 4 is a schematic diagram of the feeding mechanism viewed from above.

FIG. 4 is a schematic diagram of the feeding mechanism viewed from above.

As illustrated in FIG. 4, the recessed part 121*c* is provided in a region R1 being in the central part and being outside the opening 121*b* in the width direction A8. Further, the recessed part 121*c* is provided in a region R2 including a nip part of the feed roller 112 and the separation roller 113 in the medium conveying direction A1. While the upstream edge P3 of the recessed part 121*c* is positioned on the downstream side of the upstream edge of the feed roller 112 in the example illustrated in FIG. 4, the recessed part 121*c* may be provided in a region including the entire feed roller 112 and the entire separation roller 113 in the medium conveying direction A1.

Figure 5:
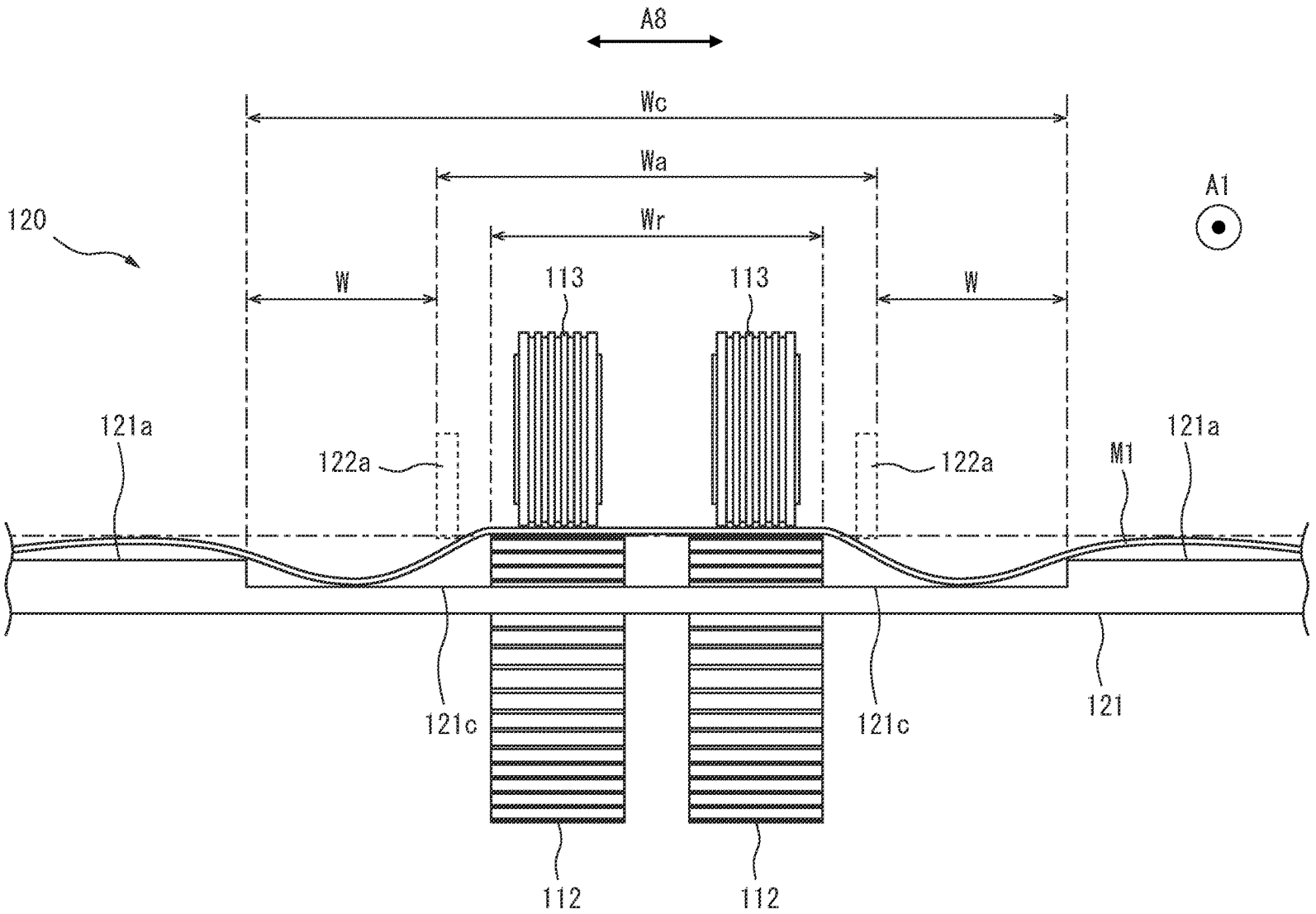
FIG. 5 is a schematic diagram of the feeding mechanism viewed from a downstream side.

FIG. 5 is a schematic diagram of the feeding mechanism viewed from the downstream side. In FIG. 5, display of parts other than the protruding part 122*a* of the feed arm 122 is omitted for enhanced visual recognizability.

As illustrated in FIG. 5, a tip (lower end) of the protruding part 122*a* is positioned on the feed roller 112 side of (below) the nip part of the feed roller 112 and the separation roller 113. A medium M1 fed by the feed roller 112 and the separation roller 113 is conveyed between the protruding part 122*a* of the feed arm 122 and the recessed part 121*c* of the guide member 121.

The protruding part 122*a* pushes down a region of the fed medium M1 facing the recessed part 121*c* in the width direction A8 below than an inner region in contact with the feed roller 112 and the separation roller 113, and a region outside the recessed part 121*c*. Consequently, the fed medium M1 is wavily bent in the width direction A8, and therefore the medium conveying apparatus 100 can stiffen the medium and can improve stiffness of the medium moving forward in the medium conveying direction A1. Accordingly, even when soft thin paper is conveyed as a medium, the medium conveying apparatus 100 can suppress occurrence of buckling of the medium and suppress occurrence of jamming of the medium. Further, even when a medium composed of a plurality of sheets of paper, such as an envelope or carbon paper, is conveyed, the medium is provided with stiffness that can resist a separating force by the separation roller 113; and therefore the medium conveying apparatus 100 can suppress occurrence of jamming of the medium.

The protruding part 122*a* pushes down the region in the medium M1 facing the recessed part 121*c* in the width direction A8 below than the inner region in contact with the feed roller 112 and the separation roller 113. Consequently, the position in a height direction perpendicular to the conveyance surface 121*a* varies between the inner region in contact with the feed roller 112 and the separation roller 113, and a region outside the inner region in the medium M1. Therefore, when a plurality of media are collectively set in the loading tray 103 and are fed, the frictional force between the medium placed between the feed roller 112 and the separation roller 113 is less likely to propagate outward in the width direction A8. Accordingly, the medium conveying apparatus 100 can suppress occurrence of jamming of a special medium, such as thin paper, an envelope, or carbon paper, while improving separation performance for normal paper, such as PPC paper.

A region outside the recessed part 121*c* in the width direction A8 in the conveyance surface 121*a* of the guide member 121 is positioned on the feed roller 112 side of (below) the nip part of the feed roller 112 and the separation roller 113. Assuming that the conveyance surface 121*a* is located above the nip part, a medium is less likely to come in contact with the feed roller 112, and the medium conveyance force is reduced. By the conveyance surface 121*a* located below the nip part, the medium conveying apparatus 100 can satisfactorily stiffen a medium while suppressing reduction in medium conveyance force.

A gap is provided between the tip of the protruding part 122*a* and the recessed part 121*c* in the height direction perpendicular to the conveyance surface 121*a*. Consequently, the medium is satisfactorily fed between the protruding part 122*a* and the recessed part 121*c* without being hampered by the protruding part 122*a* and the recessed part 121*c*.

The distance W [mm] from the outer edge of the feed roller 112 to the outer edge of the recessed part 121*c* is preferably set to satisfy Equation (1) below.

$$W = (Wc - Wr)/2 > 10 \text{ [mm]} \tag{1}$$

Wc denotes the length [mm] in the width direction A8 between both ends of the recessed parts 121*c*, and Wr denotes the length [mm] in the width direction A8 between both ends of the feed rollers 112. The length Wr in the width direction A8 between both ends of the feed rollers 112 is set to a length less than or equal to the minimum medium size width supported by the medium conveying apparatus 100 (such as the length of the A8 size in the widthwise direction).

The length We in the width direction A8 between both ends of the recessed parts 121*c* is preferably set to satisfy Equation (2) below.

$$(Wm - Wc)/2 > 10 \text{ [mm]} \tag{2}$$

Wm denotes the minimum medium size width of a mainly fed medium and, for example, is set to 148 [mm] being the length of the A5 size in the widthwise direction (the length of the A6 size in the lengthwise direction). Consequently, both ends of the fed medium are placed outside the recessed parts 121*c* in the width direction A8, and the outer region of the medium is positioned above a region facing the recessed parts 121*c*; and therefore the medium conveying apparatus 100 can satisfactorily bend the medium.

The buckling load T [gf] required for a fed medium for buckling is calculated by Equation (3) below $$T = \pi^2 \times E \times M / L^2 \tag{3}$$

E denotes the Young's modulus [GPa] of the medium. L denotes the length [mm] in the width direction A8 of a region in the medium to which the load is applied. M denotes a sectional secondary moment. The sectional secondary moment M is a characteristic of a section indicating resistance to deformation of a member against a bending force and is calculated by Equation (4) below.

$$M = H^3 \times B / 12 \tag{4}$$

H denotes the thickness [mm] of the medium, and B denotes the length [mm] in the medium conveying direction A1 of the region in the medium to which the load is applied.

Figure 6:
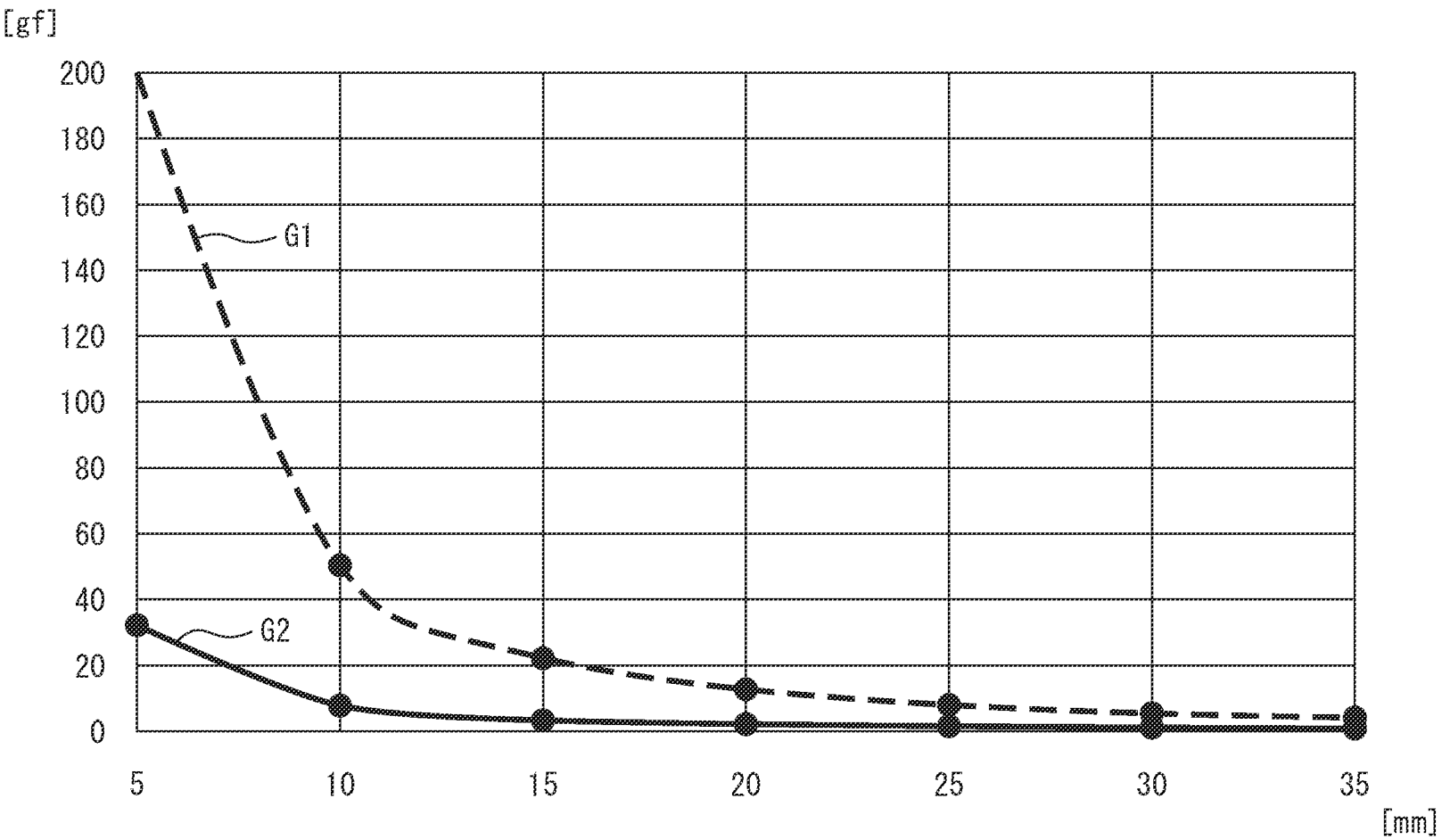
FIG. 6 is a graph illustrating a relation between a length in a width direction A8 and a buckling load for each medium.

FIG. 6 is a graph illustrating a relation between the length in the width direction A8 and the buckling load for each medium.

In FIG. 6, a graph G1 illustrates the buckling load of non-carbon paper with a Young's modulus of 3 [GPa], and a graph G2 illustrates the buckling load of thin paper with a Young's modulus of 2.2 [GPa]. In FIG. 6, the horizontal axis indicates the length [mm] in the width direction A8 of each medium, and the vertical axis indicates the buckling load [gf] of each medium. The length in the medium conveying direction A1 of a region in each medium indicated in FIG. 6 to which the load is applied is assumed to be 40 [mm]. As indicated in Equation (3), the buckling load required for buckling a medium is inversely proportional to the square of the length in the width direction A8 of the region in the medium to which the load is applied. As illustrated in FIG. 6, when the length in the width direction A8 of a medium is less than or equal to 10 [mm], the buckling load required for buckling the medium sharply increases.

Accordingly, as indicated in Equation (1), by setting the distance W from the outer edge of the feed roller 112 to the outer edge of the recessed part 121*c* greater than 10 [mm], the medium conveying apparatus 100 can satisfactorily buckle a medium with a sufficiently light buckling load. Consequently, the medium conveying apparatus 100 can buckle a region in a medium facing the recessed part 121*c* by the protruding part 122*a* and the self-weight of the medium without using a special pressing member and can satisfactorily stiffen the medium.

The length Wa in the width direction A8 between both ends of the two protruding parts 122*a* is set to a length greater than the length Wr in the width direction A8 between both ends of the feed rollers 112 and less than or equal to the minimum medium size width supported by the medium conveying apparatus 100. In other words, the two protruding parts 122*a* are located outside the two feed rollers 112 and in the neighborhood of the two feed rollers 112. Consequently, the protruding part 122*a* can reliably stiffen small-sized paper, such as the A5 size, and the medium conveying apparatus 100 can suppress occurrence of jamming of a small-sized medium.

Figure 7:
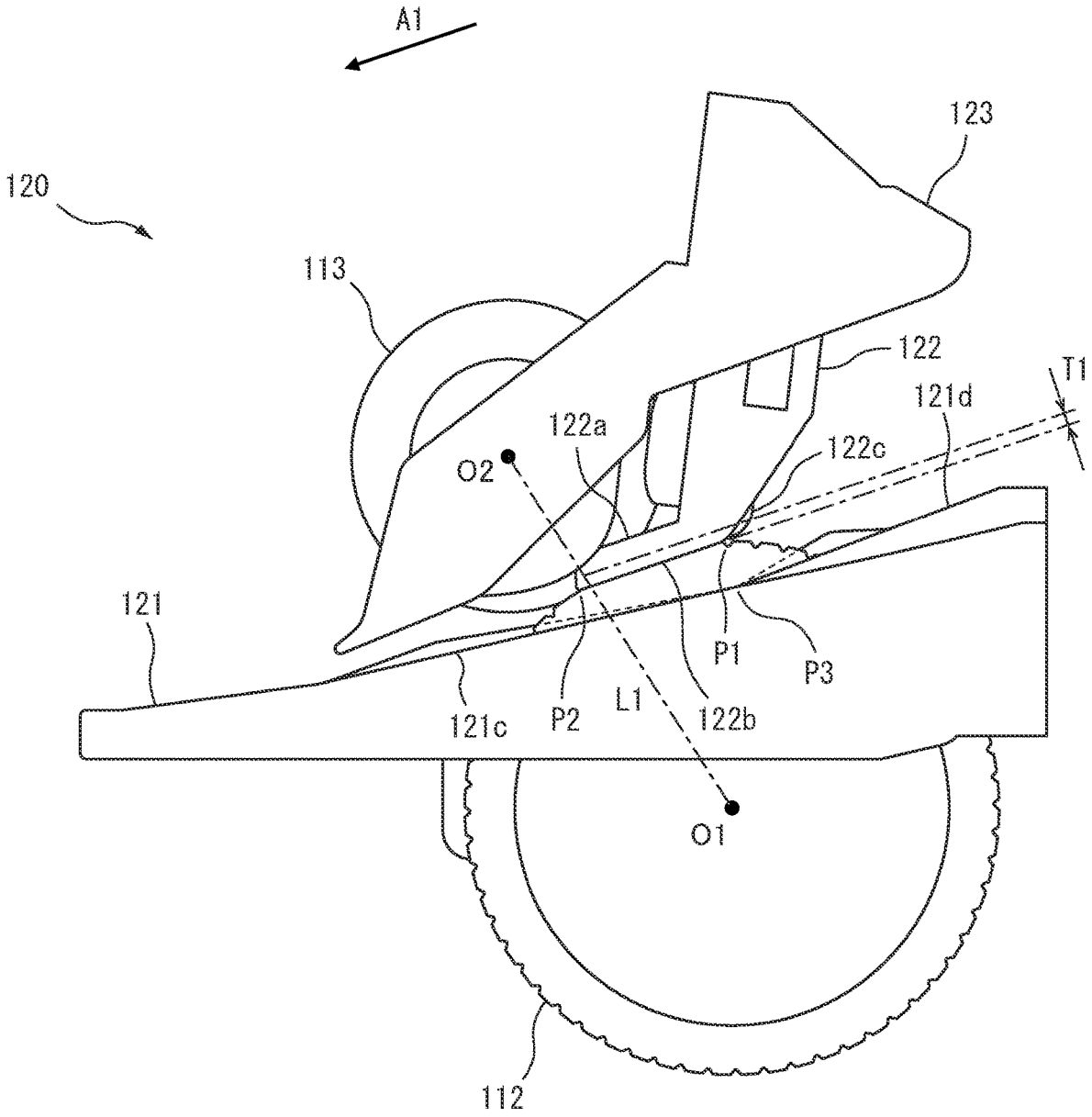
FIG. 7 is an A-A' cross-sectional view of FIG. 4.'

FIG. 7 is an A-A' cross-sectional view of FIG. 4. In other words, FIG. 7 is a diagram of the feeding mechanism viewed from the side (a diagram viewed from the width direction A8)

As illustrated in FIG. 7, the separation roller 113 is supported by a separation roller cover 123. The separation roller cover 123 is mounted on the upper housing 102 through an elastic member, such as a spring or a rubber, and is urged downward by the elastic member. Consequently, the separation roller cover 123 provides an urging force to the separation roller 113 in such a way that the separation roller 113 presses the feed roller 112.

The feed arm 122 is stored in the separation roller cover 123 in such a way as to be movable in the vertical direction relative to the separation roller cover 123. The feed arm 122 is mounted in the separation roller cover 123 through an elastic member, such as a spring or a rubber, and is urged downward relative to the separation roller cover 123 by the elastic member.

A contact surface 122*b* of the protruding part 122*a* of the feed arm 122, the surface coming in contact with a medium fed by the feed roller 112, is formed in such a way as to be in parallel with the region 121*d* on the upstream side of the recessed part 121*c* of the conveyance surface 121*a* of the guide member 121 in the medium conveying direction A1. The contact surface 122*b* being in parallel with the region 121*d* is not limited to being completely in parallel and means that an angle formed by the contact surface 122*b* and the region 121*d* is less than or equal to a predetermined angle (such as 5°). By the contact surface 122*b* being formed in parallel with the region 121*d*, the protruding part 122*a* can smoothly guide a medium guided by the conveyance surface 121*a* of the guide member 121 toward the downstream side.

Assuming that the contact surface 122*b* is tilted in such a way that the downstream side of the contact surface 122*b* sinks relative to the region 121*d* (toward the feed roller 112 side), the magnitude of the load received by a medium from the protruding part 122*a* gradually increases as the medium is conveyed and the medium conveyance force decreases. In that case, when the medium is conveyed in a tilted manner, the magnitude of the load received by the medium from the left protruding part 122*a* differs from that of the load received from the right protruding part 122*a*, and therefore the tilt of the medium increases. On the other hand, when the contact surface 122*b* is tilted in such a way that the downstream side of the contact surface 122*b* floats relative to the region 121*d* (toward the separation roller 113 side), the force provided by the protruding part 122*a* for stiffening the medium decreases. By the contact surface 122*b* provided in parallel with the region 121*d*, the medium conveying apparatus 100 can satisfactorily stiffen the medium while suppressing reduction in the medium conveyance force and occurrence of a skew of the medium.

The protruding part 122*a* is located in such a way that, viewed from the width direction A8 perpendicular to the medium conveying direction A1, at least part of the protruding part 122*a* overlaps the nip part of the feed roller 112 and the separation roller 113, and a region of the feed roller 112 on the upstream side of the nip part in the medium conveying direction A1. In other words, the upstream edge P1 of the protruding part 122*a* is located on the downstream side of the upstream edge of the feed roller 112 and on the upstream side of the upstream edge of the nip part of the feed roller 112 and the separation roller 113 in the medium conveying direction A1. Consequently, stiffening is performed on a fed medium by the protruding part 122*a* before the nip part of the feed roller 112 and the separation roller 113. Accordingly, the medium conveying apparatus 100 can improve stiffness of a medium and can suppress occurrence of jamming of the medium when the medium enters the nip part. Further, even when the front edge of a fed medium is curled upward, the curled part is pressed down by the protruding part 122*a*, and therefore the medium is satisfactorily guided to the nip part of the feed roller 112 and the separation roller 113.

The downstream edge P2 of the protruding part 122*a* is located on the downstream side of a straight line LI connecting the center O1 of the feed roller 112 and the center O2 of the separation roller 113 and on the upstream side of the downstream edge of the feed roller 112 in the medium conveying direction A1. Further, the edge P2 is located in the neighborhood of the downstream edge of the nip part of the feed roller 112 and the separation roller 113 in the medium conveying direction A1. In particular, the edge P2 is located on the upstream side of the downstream edge of the nip part in the medium conveying direction A1. The edge P2 may be located on the downstream side of the downstream edge of the nip part in the medium conveying direction A1. In general, jamming of a medium is likely to occur in a period from immediately before entry of the medium into the nip part until the medium passes the nip part. By the protruding part 122*a* extending to the neighborhood of the downstream edge of the nip part, stiffening is performed on the medium by the protruding part 122*a* in the neighborhood of the nip part. Accordingly, the medium conveying apparatus 100 can improve stiffness of the medium and can suppress occurrence of jamming of the medium while the medium is passing the nip part.

The protruding part 122*a* is located in such a way that at least part of the protruding part 122*a* is positioned below the upper edge of the feed roller 112 in the height direction perpendicular to the conveyance surface 121*a*. The bottom surface of the protruding part 122*a* is located in such a way as to be positioned below the upper edge of the feed roller 112 by a predetermined distance TI (for example, greater than or equal to 0.1 mm and less than or equal to 5 mm) or greater.

Figure 8:
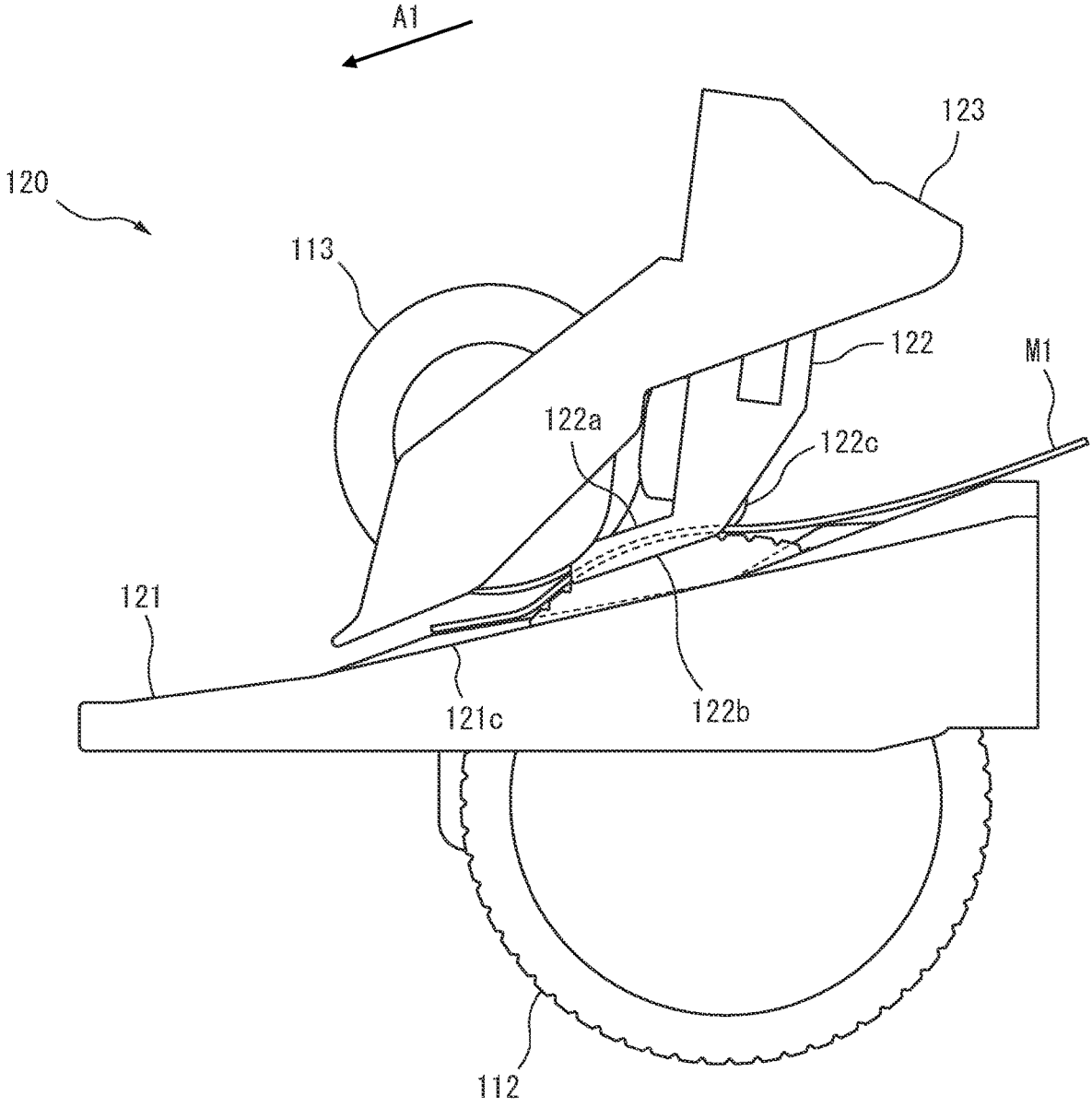
FIG. 8 is a schematic diagram illustrating a situation in which a medium M1 is fed by the feeding mechanism.

FIG. 8 is a schematic diagram illustrating a situation in which a medium M1 is fed by the feeding mechanism. FIG. 8 is a schematic diagram of the feeding mechanism 120 viewed from the side.

As illustrated in FIG. 8, by the outer part of the fed medium M1 in the width direction A8 pushed down by the protruding part 122*a*, a part of the fed medium M1 facing the feed roller 112 extends along the surface of the feed roller 112. Consequently, the medium M1 is wavily bent in the medium conveying direction A1, and therefore the medium conveying apparatus 100 can stiffen the medium M1 and can improve stiffness of the medium M1 moving forward in the medium conveying direction A1. Accordingly, even when thin paper, an envelope, or carbon paper is conveyed as a medium, the medium conveying apparatus 100 can suppress occurrence of jamming of the medium.

Figure 9:
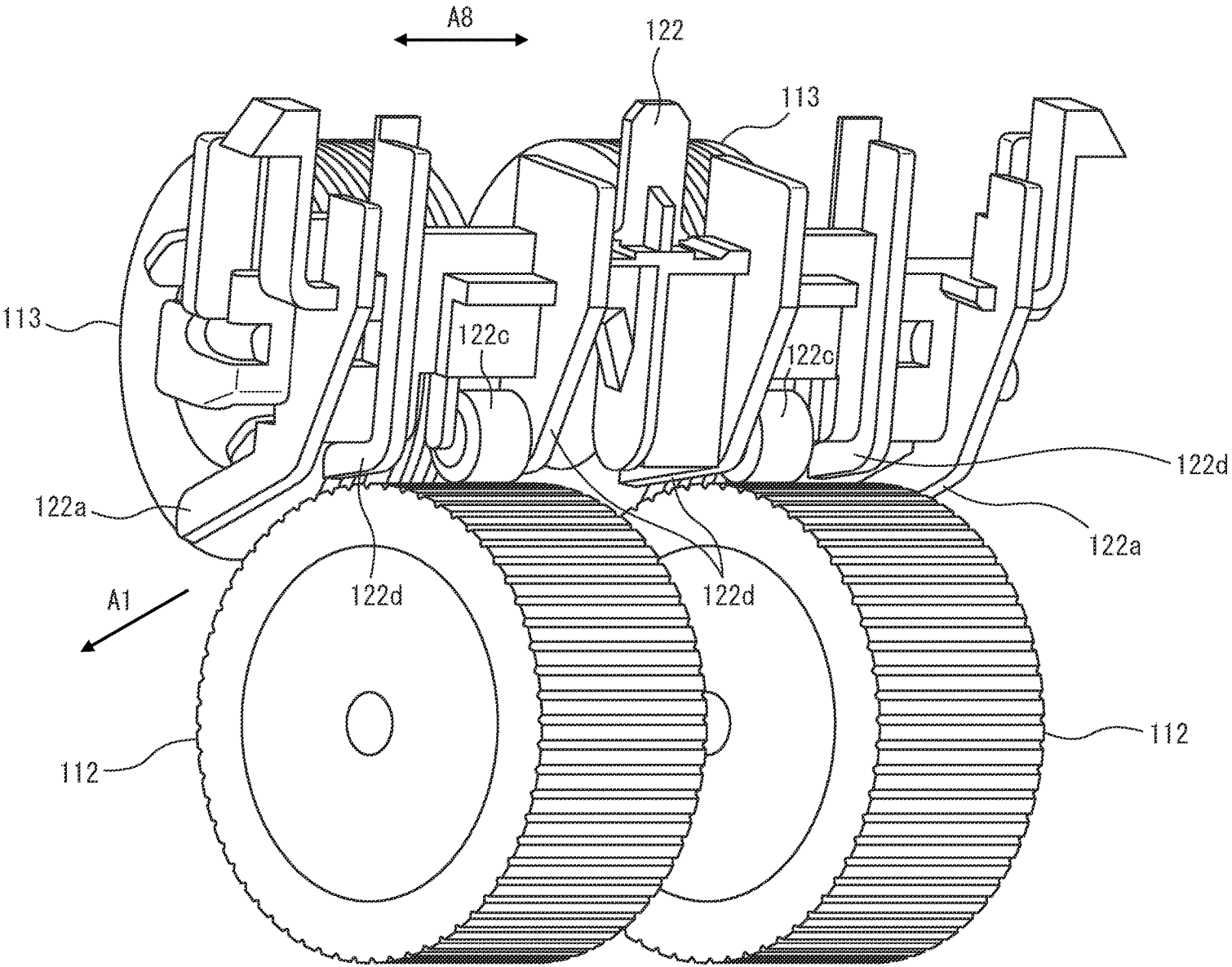
FIG. 9 is a perspective view of an example of a feed arm etc., viewed from an upstream side.
Figure 10:
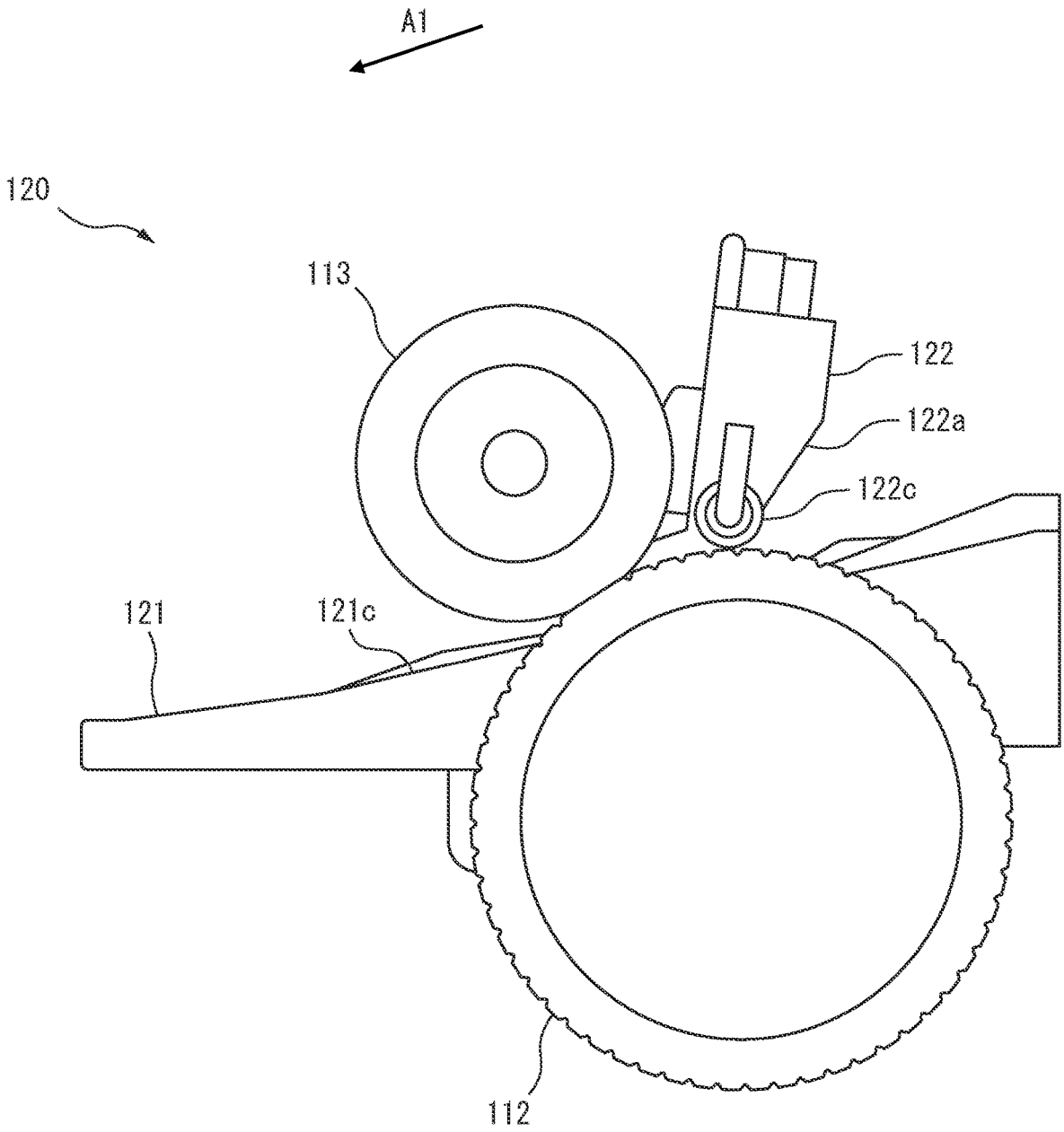
FIG. 10 is a B-B' cross-sectional view of FIG. 4.
Figure 11:
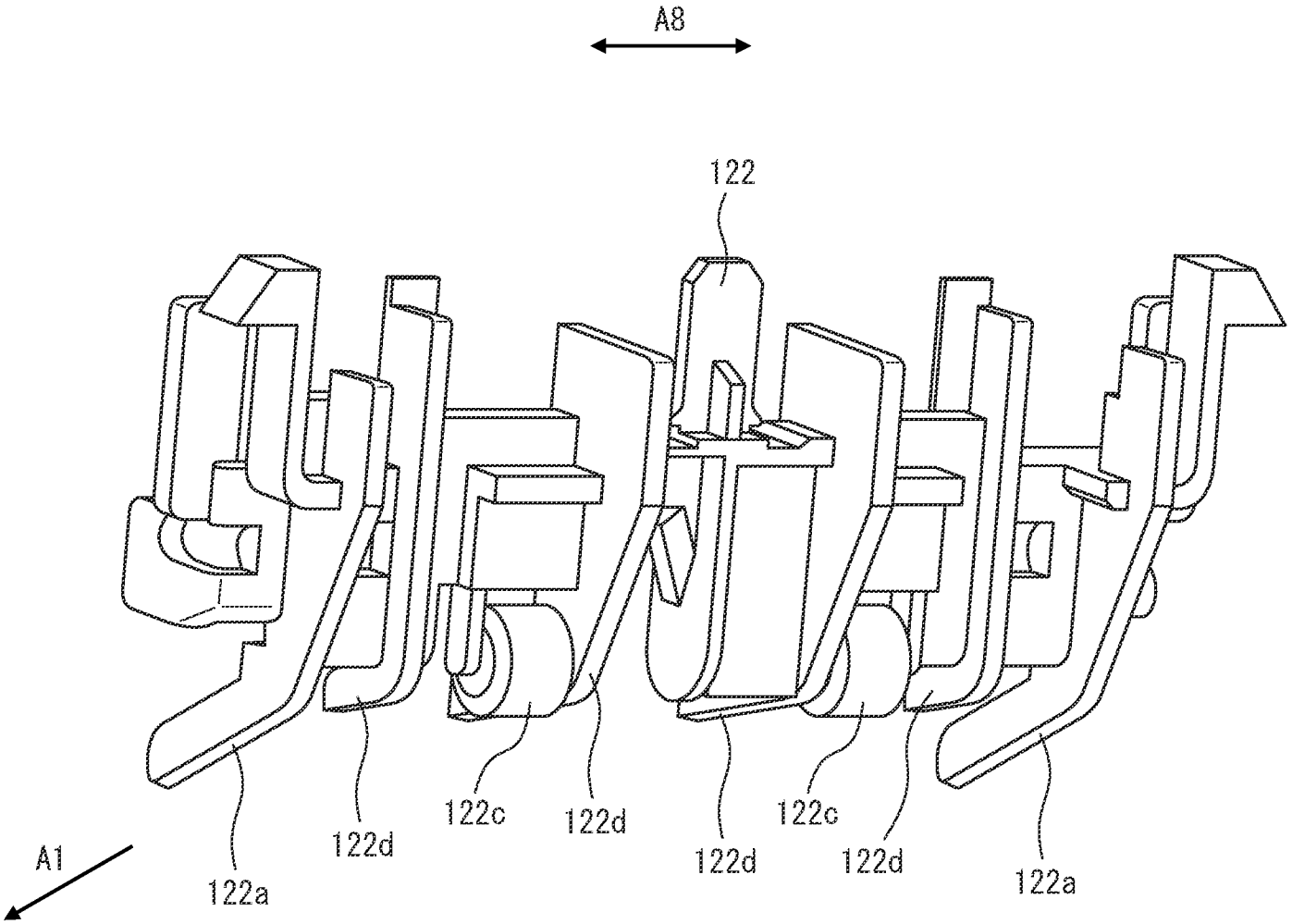
FIG. 11 is a perspective view of the feed arm viewed from the upstream side.

FIG. 9 is a perspective view of the feed arm, the feed roller, and the separation roller viewed from the upstream side. FIG. 10 is a B-B' cross-sectional view of FIG. 4. In other words, FIG. 10 is a diagram of the feeding mechanism viewed from the side. FIG. 11 is a perspective view of the feed arm viewed from the upstream side.

As illustrated in FIG. 9, the feed arm 122 further includes a press roller 122*c* and a second protruding part 122*d*.

As illustrated in FIG. 9 and FIG. 10, the press roller 122*c* faces the feed roller 112 and is located on the upstream side of the nip part of the feed roller 112 and the separation roller 113 in the medium conveying direction A1. The press roller 122*c* is located in the neighborhood of the upstream edge P1 of the protruding part 122*a* in the medium conveying direction A1. The press roller 122*c* presses a medium fed by the feed roller 112 to the feed roller 112 side from above. In the example illustrated in FIG. 9 and FIG. 10, the feed arm 122 includes two press rollers 122*c*. The press roller 122*c* and the feed roller 112 sandwich the medium in between, and the press roller 122*c* provides a conveyance force to the medium fed by the feed roller 112. Consequently, the medium conveying apparatus 100 can satisfactorily feed the medium.

The press roller 122*c* is provided on the feed arm 122 on which the protruding part 122*a* is provided and is provided to move in conjunction with the protruding part 122*a*. Consequently, the medium conveying apparatus 100 can simply control the feed arm 122 and the press roller 122*c*, which enables reduction in the development cost of the medium conveying apparatus 100. Further, by forming the protruding part 122*a* and the press roller 122*c* as one part, the medium conveying apparatus 100 can reduce the apparatus cost and the apparatus weight.

By the central part of a medium being pressed down by the press roller 122*c* in the width direction A8, the outer part of the medium is more likely to lift. However, since the outer part of the medium is pressed down by the protruding part 122*a*, the medium conveying apparatus 100 can suppress occurrence of buckling of the medium due to the side of a lifting medium coming in contact with a rubber surface of the separation roller 113.

As illustrated in FIG. 9 and FIG. 11, the second protruding part 122*d* faces the feed roller 112 and is located on the upstream side of the nip part of the feed roller 112 and the separation roller 113 in the medium conveying direction A1. In other words, the second protruding part 122*d* is positioned on the separation roller 113 side of (above) the nip part of the feed roller 112 and the separation roller 113. The second protruding part 122*d* guides a medium fed by the feed roller 112 to the nip part of the feed roller 112 and the separation roller 113. In the example illustrated in FIG. 9 and FIG. 11, the feed arm 122 includes two second protruding parts 122*d* located to sandwich each press roller 122*c* in between in the width direction A8 for one feed roller 112 and includes four second protruding parts 122*d* in total.

A fed medium is guided to the nip part of the feed roller 112 and the separation roller 113 by the second protruding part 122*d*. In particular, even when the fed medium is, for example, a medium of which front edge is curled upward or thin paper, the medium conveying apparatus 100 can reliably guide the medium to the nip part. The medium conveying apparatus 100 can press down a lift of a part of a medium not facing the feed roller 112 by the protruding part 122*a* while pressing down a lift of a part of the medium facing the feed roller 112 by the second protruding part 122*d*. Consequently, the medium conveying apparatus 100 can more satisfactorily suppress occurrence of a lift of the front edge of a medium and can suppress occurrence of buckling of a medium with a lifting front edge due to the medium being flipped up by the separation roller 113.

In particular, the second protruding part 122*d* is located to overlap the press roller 122*c* viewed from the width direction A8. In other words, in the medium conveying direction A1, the upstream edge of the second protruding part 122*d* is located in the neighborhood of the press roller 122*c*, and the downstream edge of the second protruding part 122*d* is located in the neighborhood of the nip part of the feed roller 112 and the separation roller 113. Consequently, the second protruding part 122*d* can suitably guide a medium pressed by the press roller 122*c* to the nip part of the feed roller 112 and the separation roller 113. The upstream edge of the second protruding part 122*d* is located on the downstream side of the press roller 122*c*. Alternatively, the upstream edge of the second protruding part 122*d* may be located on the upstream side of the press roller 122*c*.

The press roller 122*c* and/or the second protruding part 122*d* may be omitted.

Figure 12:
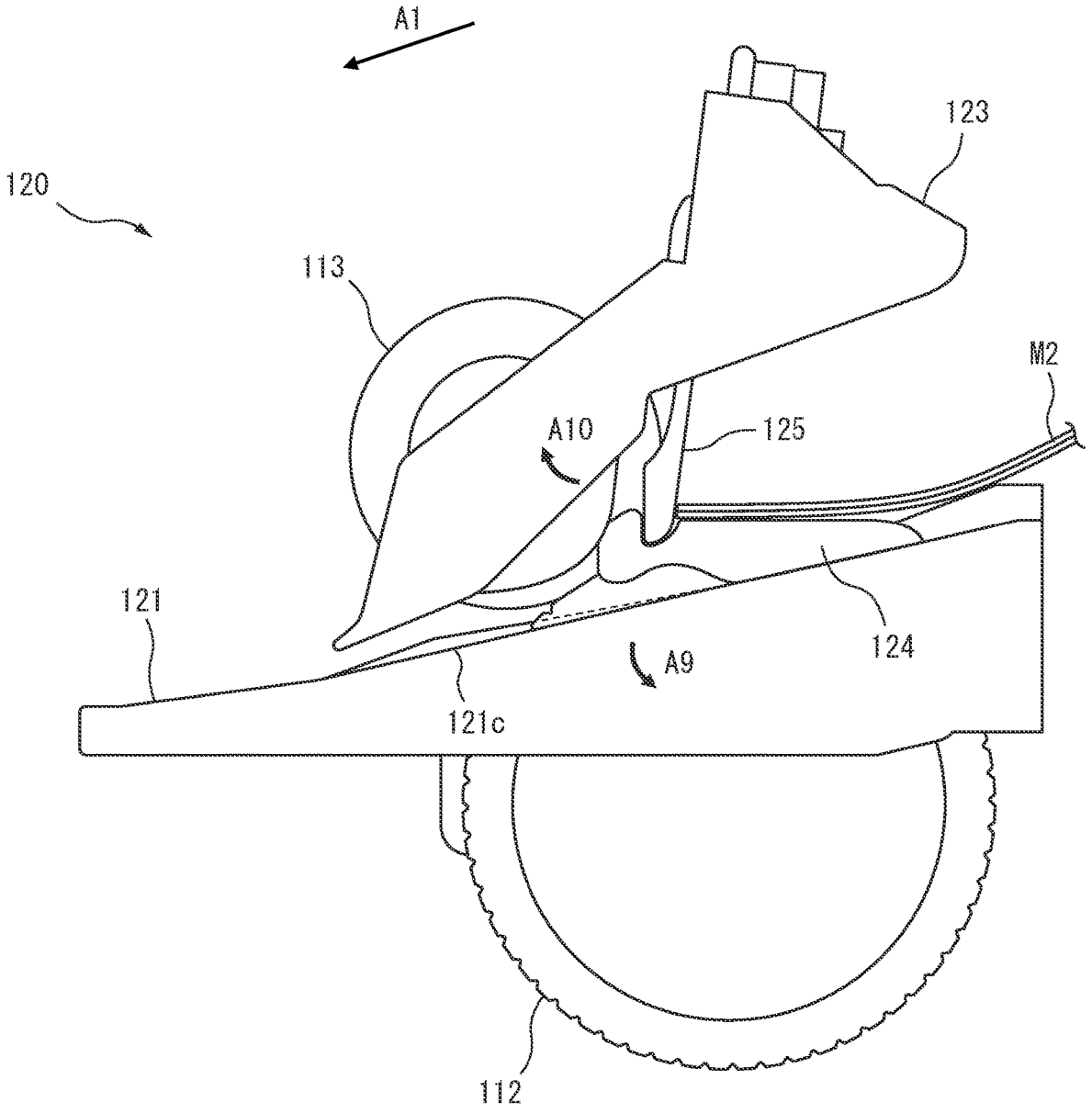
FIG. 12 is a schematic diagram for illustrating an example of a setting guide etc.

FIG. 12 is a schematic diagram for illustrating an example of a setting guide and a flap. FIG. 12 is a diagram of the feeding mechanism before medium feeding viewed from the side.

As illustrated in FIG. 12, the feeding mechanism 120 further includes the setting guide 124 and the flap 125.

The setting guide 124 is an example of a second guide member and is a guide for setting a medium. The setting guide 124 is located at a position facing the feed roller 112 and the separation roller 113 in the medium conveying direction A1. The setting guide 124 is provided in the lower housing 101 in such a way as to be able to swing (rotate) downward (in a direction of an arrow A9 in FIG. 12) according to a driving force from an unillustrated motor. Before medium feeding, the setting guide 124 is located at a first position (a placement position in FIG. 12) where contact between a medium M2 placed in the loading tray 103, and the feed roller 112 and the press roller 122*c* is restricted and supports the bottom surface of the medium M2 placed in the loading tray 103.

The flap 125 is a stopper for preventing the medium M2 from entering a nip part of the feed roller 112 and the separation roller 113 before medium feeding. The flap 125 is located at a position facing the setting guide 124 in the medium conveying direction A1. The flap 125 is provided on the feed arm 122 in such a way as to be able to swing (rotate) to the downstream side (in a direction of an arrow A10 in FIG. 12) and is pressed toward the upstream side (a direction opposite to the arrow A10) by an unillustrated spring. Before medium feeding, the flap 125 is engaged with the setting guide 124 located at the first position and prevents the medium M2 from entering the nip position of the feed roller 112 and the separation roller 113. The flap 125 is provided to work with the feed arm 122; and when the flap 125 is engaged with the setting guide 124, the feed arm 122 is supported by the flap 125 and the setting guide 124, and downward movement of the feed arm 122 is prevented. Therefore, the feed arm 122 is stored in the separation roller cover 123 in FIG. 12

Figure 13:
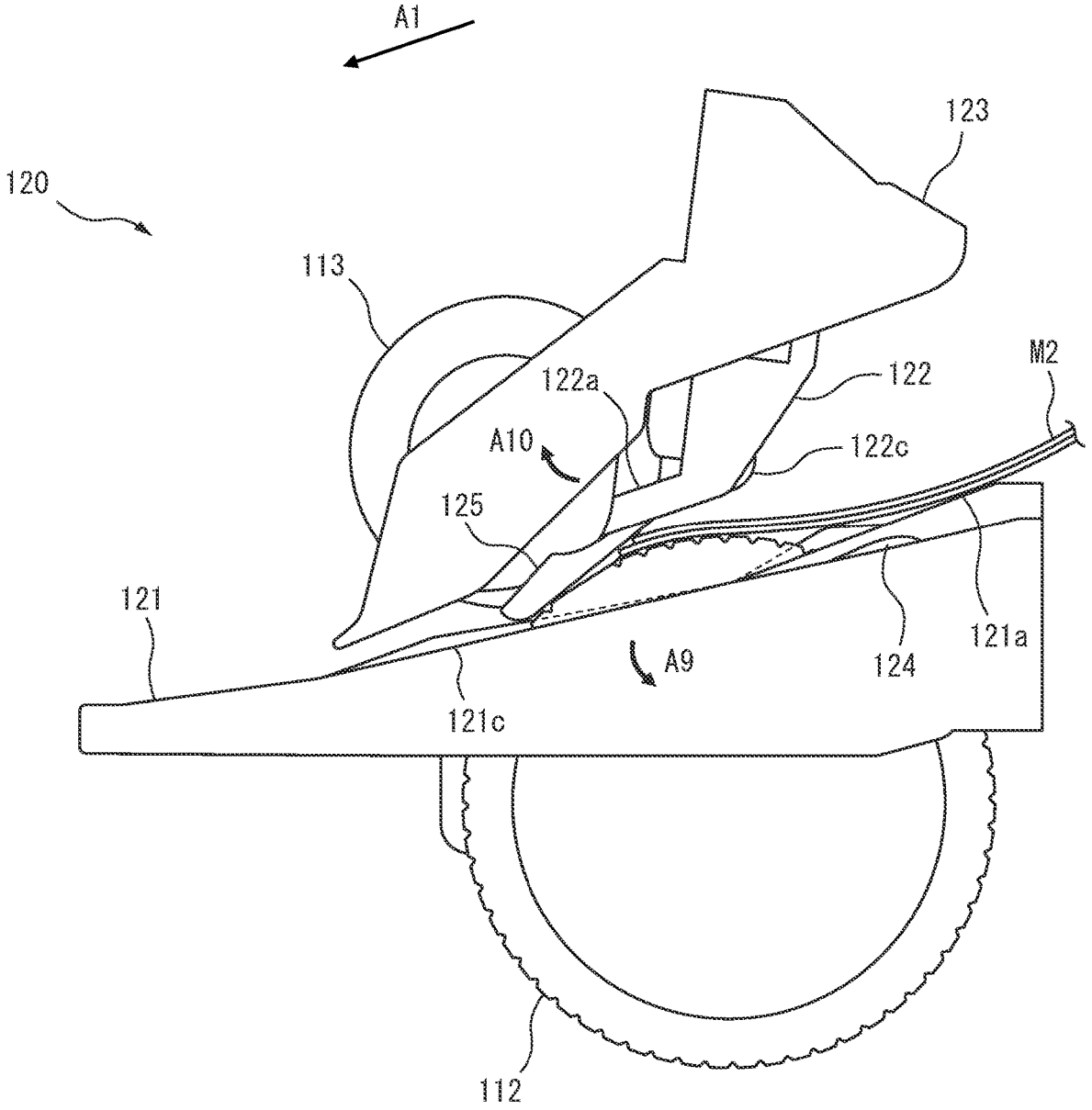
FIG. 13 is a schematic diagram for illustrating the setting guide etc.

FIG. 13 is a schematic diagram for illustrating the setting guide and the flap during medium feeding. FIG. 13 is a schematic diagram of the feeding mechanism during medium feeding viewed from the side.

As illustrated in FIG. 13, the setting guide 124 swings below the conveyance surface 121*a* (in the direction of the arrow A9) when medium feeding is started. Consequently, at the time of medium feeding, the setting guide 124 is located at a second position (a placement position in FIG. 13) where contact between the medium M2 placed in the loading tray 103, and the feed roller 112 and the press roller 122*c* is allowed and separates from the bottom surface of the medium M2 placed in the loading tray 103.

By the setting guide 124 being located at the second position, the engagement between the flap 125 and the setting guide 124 is released. Consequently, the flap 125 is pushed by the front edge of the medium M2 placed in the loading tray 103 and swings to the downstream side (the direction of the arrow A10), and the medium M2 becomes able to enter the nip part of the feed roller 114 and the separation roller 115. Thus, the flap 125 allows entry of the medium M1 into the nip part of the feed roller 112 and the separation roller 113 when the setting guide 124 is located at the second position.

As described above, since the feed arm 122 is urged downward by the elastic member, the feed arm 122 moves downward (to the feed roller 112 side) by release of the engagement between the flap 125 and the setting guide 124. In the example illustrated in FIG. 12 and FIG. 13, an amount of media M2 placed in the loading tray 103 is sufficiently small. In this case, first, the feed roller 112 comes in contact with a medium placed lowest out of the media M2 placed in the loading tray 103, and the press roller 122*c* subsequently comes in contact with a medium placed uppermost out of the media M2 placed in the loading tray 103. In other words, the press roller 122*c* is provided to come in contact with a medium placed in the loading tray 103 after the feed roller 112 comes in contact with the medium when an amount of media placed in the loading tray 103 is less than a predetermined amount, at a time when the setting guide 124 moves from the first position to the second position.

When rotation of the feed roller 112 is started in a state of the press roller 122*c* pressing a medium in a case of an amount of media placed in the loading tray 103 being small, the front edge of the medium is likely to be bent upward and thus a jam of the medium is likely to occur. By causing the feed roller 112 to come in contact with a medium before the press roller 122*c* and start feeding of the medium when an amount of media is less than the predetermined amount, the medium conveying apparatus 100 can suppress occurrence of a jam of the medium due to upward bending of the front edge of the medium.

Figure 14:
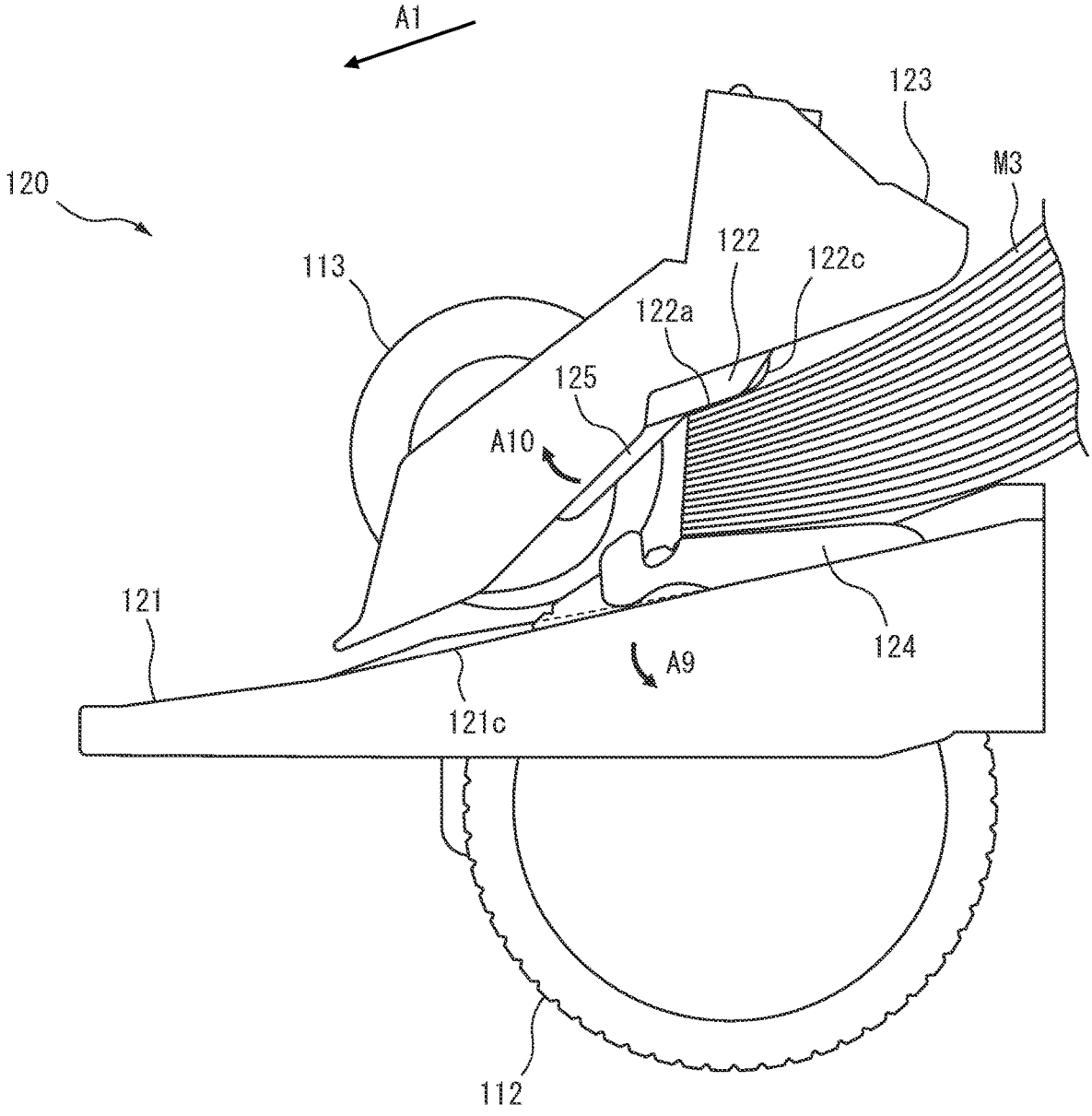
FIG. 14 is a schematic diagram for illustrating the setting guide etc.

FIG. 14 is a schematic diagram for illustrating the setting guide and the flap when a large amount of media M3 are placed in the loading tray. FIG. 14 is a schematic diagram of the feeding mechanism viewed from the side immediately after medium feeding starts when a large amount of the media M3 are placed in the loading tray.

As described above, when medium feeding starts, the setting guide 124 is moved to the second position, the engagement between the flap 125 and the setting guide 124 is released, and the feed arm 122 moves downward. As illustrated in FIG. 14, when a large amount of the media M3 are placed in the loading tray 103, the feed arm 122 is lowered before the setting guide 124 is fully lowered. Therefore, the press roller 122*c* comes in contact with a medium placed uppermost out of the media M3 placed in the loading tray 103 before the feed roller 112 comes in contact with a medium placed lowest out of the medium M3 placed in the loading tray 103. In other words, the press roller 122*c* is provided to come in contact with a medium placed in the loading tray 103 before the feed roller 114 comes in contact with the medium when an amount of media placed in the loading tray 103 is greater than or equal to a predetermined amount, at a time when the setting guide 124 moves from the first position to the second position.

When an amount of media placed in the loading tray 103 is large, the feed roller 114 can satisfactorily send out a medium by starting rotation of the feed roller 114 in a state of the press roller 122*c* pressing the medium. In particular, when an amount of media placed in the loading tray 103 is large, stronger urging force is provided to a medium by the elastic member compared with a case where the amount of media is small. For example, when the elastic member is a compression spring, the magnitude of the urging force is a multiplied value acquired by multiplying a contracted amount of the spring by a spring constant. When an amount of media placed in the loading tray 103 is large, the contracted amount of the spring is large and strong urging force is provided to a medium by the press roller 122*c*, and therefore the feed roller 112 can satisfactorily feed the medium.

When an amount of media placed in the loading tray 103 is large, the front edge of a feed target medium existing at the lowest position is pressed down by the weight of media placed thereon, and therefore the possibility of the front edge of the target medium being bent upward is low. Accordingly, when an amount of media placed in the loading tray 103 is large and the possibility of occurrence of a jam of a medium is low, the medium conveying apparatus 100 can satisfactorily feed a medium while giving priority to feedability of a medium.

Figure 15:
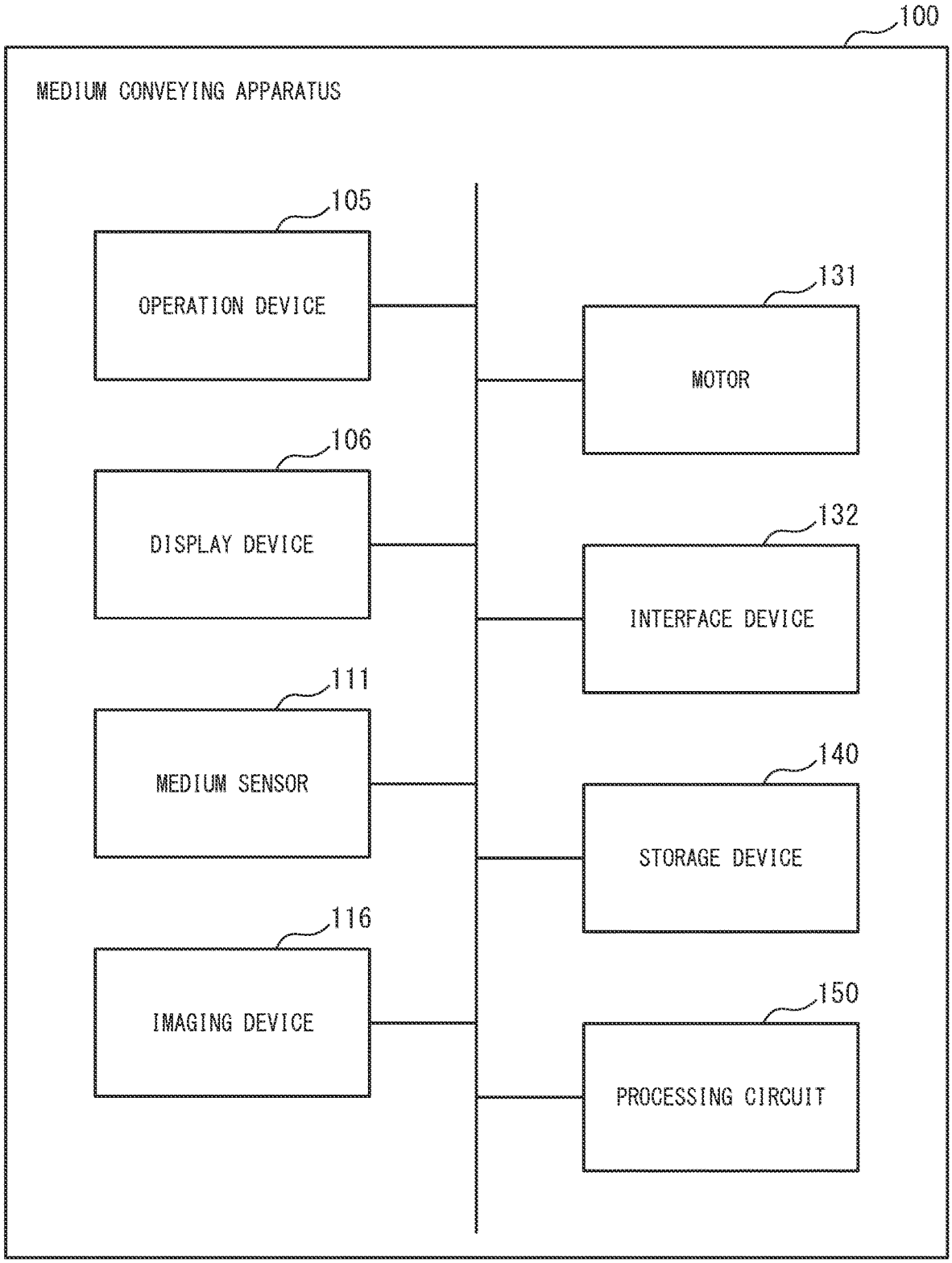
FIG. 15 is a block diagram illustrating a schematic configuration of the medium conveying apparatus.

FIG. 15 is a block diagram illustrating a schematic configuration of the medium conveying apparatus.

In addition to the configuration described above, the medium conveying apparatus 100 further includes a motor 131, an interface device 132, a storage device 140, a processing circuit 150, etc.

The motor 131 includes one or a plurality of motors and conveys a medium by rotating the feed roller 112, the separation roller 113, the first conveyance roller 114, the second conveyance roller 115, the first ejection roller 117, and the second ejection roller 118 in accordance with a control signal from the processing circuit 150. One of the first conveyance roller 114 and the second conveyance roller 115 may be a driven roller driven to rotate by the other roller. One of the first ejection roller 117 and the second ejection roller 118 may be a driven roller driven to rotate by the other roller. The motor 131 moves the bottom surface guide 124 between the first position and the second position in accordance with the control signal from the processing circuit 150.

For example, the interface device 132 includes an interface circuit conforming to a serial bus such as USB and transmits and receives an input image and various types of information by being electrically connected to an unillustrated information processing apparatus (such as a personal computer or a mobile information terminal). A communication device including an antenna transmitting and receiving wireless signals and a wireless communication interface circuit for transmitting and receiving signals through a wireless communication line in accordance with a predetermined communication protocol may be used in place of the interface device 132. For example, the predetermined communication protocol is a wireless local area network (LAN). The communication device may include a wired communication interface circuit for transmitting and receiving signals through a wired communication line in accordance with a communication protocol such as a wired LAN.

The storage device 140 includes a memory device such as a random-access memory (RAM) or a read-only memory (ROM), a fixed disk device such as a hard disk, a portable storage device such as a flexible disk or an optical disk, etc. Further, a computer program, a database, a table, etc., that are used for various types of processing in the medium conveying apparatus 100 are stored in the storage device 140. The computer programs may be installed on the storage device 140 from a computer-readable, non-transitory portable storage medium by using a well-known set-up program, etc. The portable storage medium is, for example, a compact disc read-only memory (CD-ROM) or a digital versatile disc read-only memory (DVD-ROM).

The processing circuit 150 operates in accordance with a program previously stored in the storage device 140. For example, the processing circuit is a central processing unit (CPU). Examples of the processing circuit 150 that may also be used include a digital signal processor (DSP), a large scale integration (LSI), an application specific integrated circuit (ASIC), and a field-programmable gate array (FPGA).

The processing circuit 150 is connected to the operation device 105, the display device 106, the medium sensor 111, the imaging device 116, the motor 131, the interface device 132, the storage device 140, etc., and controls the components. The processing circuit 150 performs drive control of the motor 131, imaging control of the imaging device 116, etc., based on the medium signal received from the medium sensor 111, acquires an input image from the imaging device 116, and transmits the acquired image to the information processing apparatus through the interface device 132.

Figure 16:
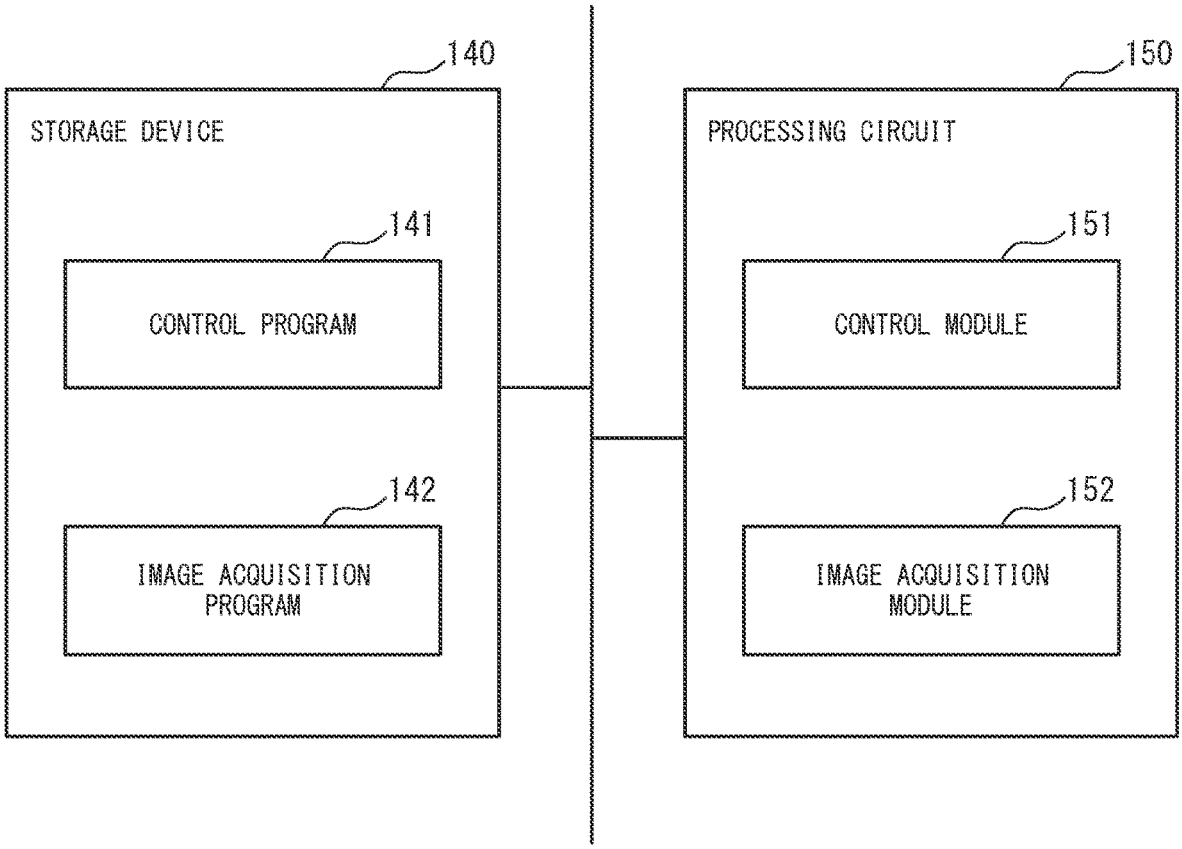
FIG. 16 is a diagram illustrating a schematic configuration of an example of a storage device and a processing circuit.

FIG. 16 is a diagram illustrating a schematic configuration of the storage device land the processing circuit.

As illustrated in FIG. 16, a control program 141 and an image acquisition program 142, etc., are stored in the storage device 140. Each program is a functional module implemented by software operating on the processor. The processing circuit 150 reads each program stored in the storage device 140 and operates in accordance with the read program. Consequently, the processing circuit 150 functions as a control module 151 and an image acquisition module 152.

Figure 17:
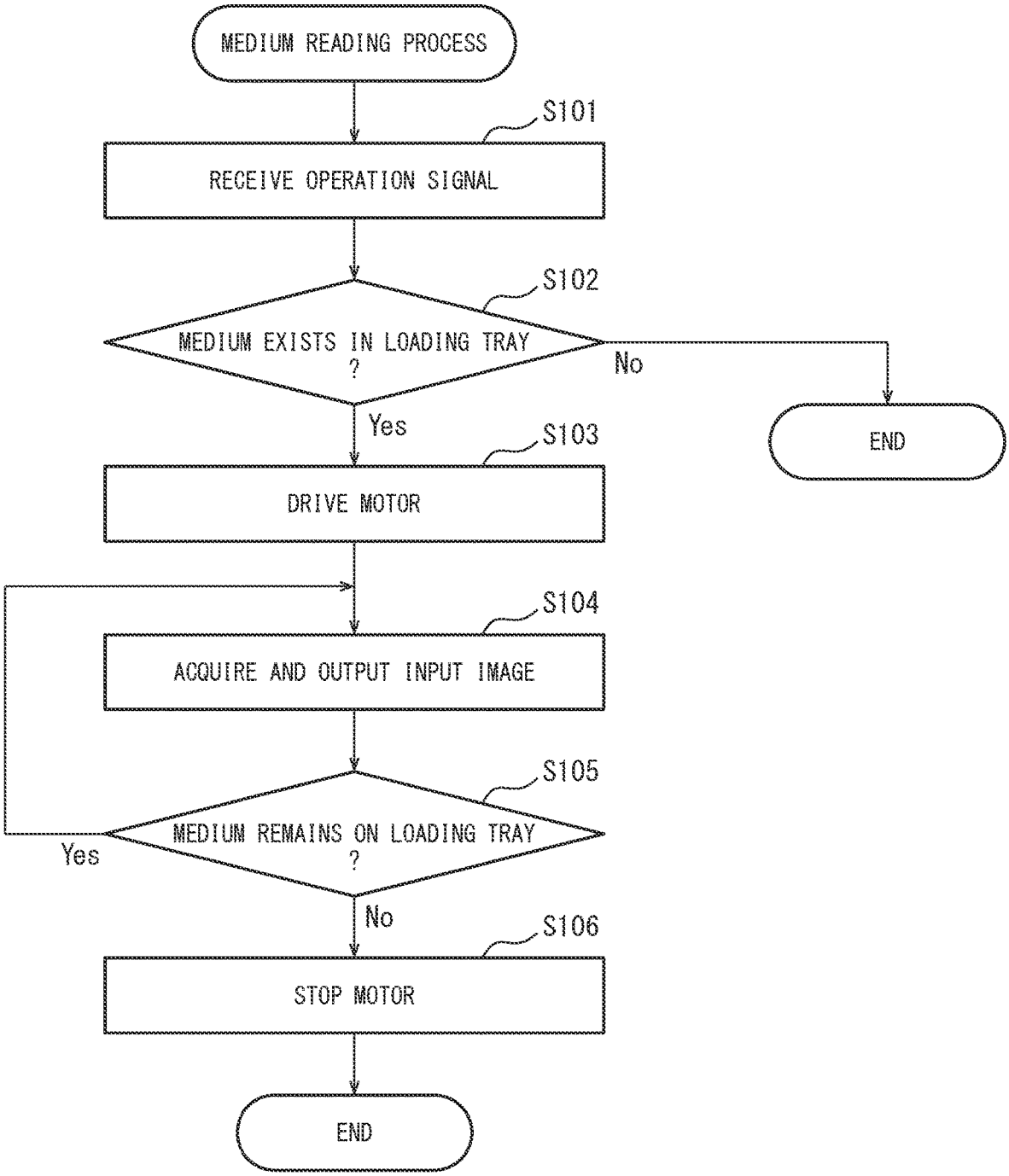
FIG. 17 is a flowchart illustrating an operation example of medium reading processing.

FIG. 17 is a flowchart illustrating an operation example of medium reading processing in the medium conveying apparatus.

The operation example of the medium reading process in the medium conveying apparatus 100 will be described below referring to the flowchart illustrated in FIG. 12. The operation flow described below is executed mainly by the processing circuit 150 in accordance with a program previously stored in the storage device 140 in cooperation with the components in the medium conveying apparatus 100. The setting guide 124 is located at the first position before execution of the flowchart illustrated in FIG. 12, i.e., before medium feeding.

First, the control module 151 waits until an instruction to read a medium is input by a user by using the operation device 105 or the information processing apparatus and an operation signal providing an instruction to read a medium is received from the operation device 105 or the interface device 132 (step S101).

Next, the control module 151 acquires the medium signal from the medium sensor 113 and determines whether a medium exists on the loading tray 103, based on the acquired medium signal (step S102). When a medium does not exist on the loading tray 103, the control module 151 ends the series of steps.

On the other hand, when a medium exists on the loading tray 103, the control module 151 moves the bottom surface guide 124 from the first position to the second position by driving the motor 131. Further, the control module 151 conveys the medium by rotating the feed roller 112, the separation roller 113, the first conveyance roller 114, the second conveyance roller 115, the first ejection roller 117, and/or the second ejection roller 118 by driving the motor 131 (step S103).

Next, the control module 151 acquires an input image from the imaging device 116 by causing the imaging device 116 to image the medium and outputs the acquired input image by transmitting the image to the information processing apparatus through the interface device 132 (step S104).

Next, the control module 151 determines whether a medium remains on the loading tray 103, based on the medium signal received from the medium sensor 113 (step S105). When a medium remains in the loading tray 103, the control module 151 returns the processing to step S104 and repeats the processing in step S104 and S105.

On the other hand, when a medium does not remain on the loading tray 103, the control module 151 controls the motor 131 to stop the feed roller 112, the separation roller 113, the first conveyance roller 114, the second conveyance roller 115, the first ejection roller 117, and/or the second ejection roller 118. Further, the control module 151 controls the motor 131 to move the setting guide 124 from the second position to the first position (step S106) and ends the series of steps.

As described in detail above, the medium conveying apparatus 100 is provided with the recessed part 121*c* in a region around the feed roller 112 in the conveyance surface 121*a* of a medium. Furthermore, the medium conveying apparatus 100 is provided with the protruding part 122*a* guiding a region in the medium outside the feed roller 112 to a region on the feed roller 112 side of the nip part of the feed roller 112 and the separation roller 113. Consequently, when various types of media, such as thin paper, an envelope, and carbon paper, are conveyed, the medium conveying apparatus 100 can suppress occurrence of jamming of a medium. Accordingly, the medium conveying apparatus 100 can suitably feed a plurality of types of media.

The medium conveying apparatus 100 can convey a bound medium, such as an envelope or carbon paper, even when the feed mode is set to the non-separation mode. Consequently, the medium conveying apparatus 100 can successively convey a plurality of envelopes or a plurality of sheets of carbon paper. A user does not need to change the setting of the feed mode when a bound medium, such as an envelope or carbon paper, is conveyed; and the medium conveying apparatus 100 can improve user convenience.

Figure 18:
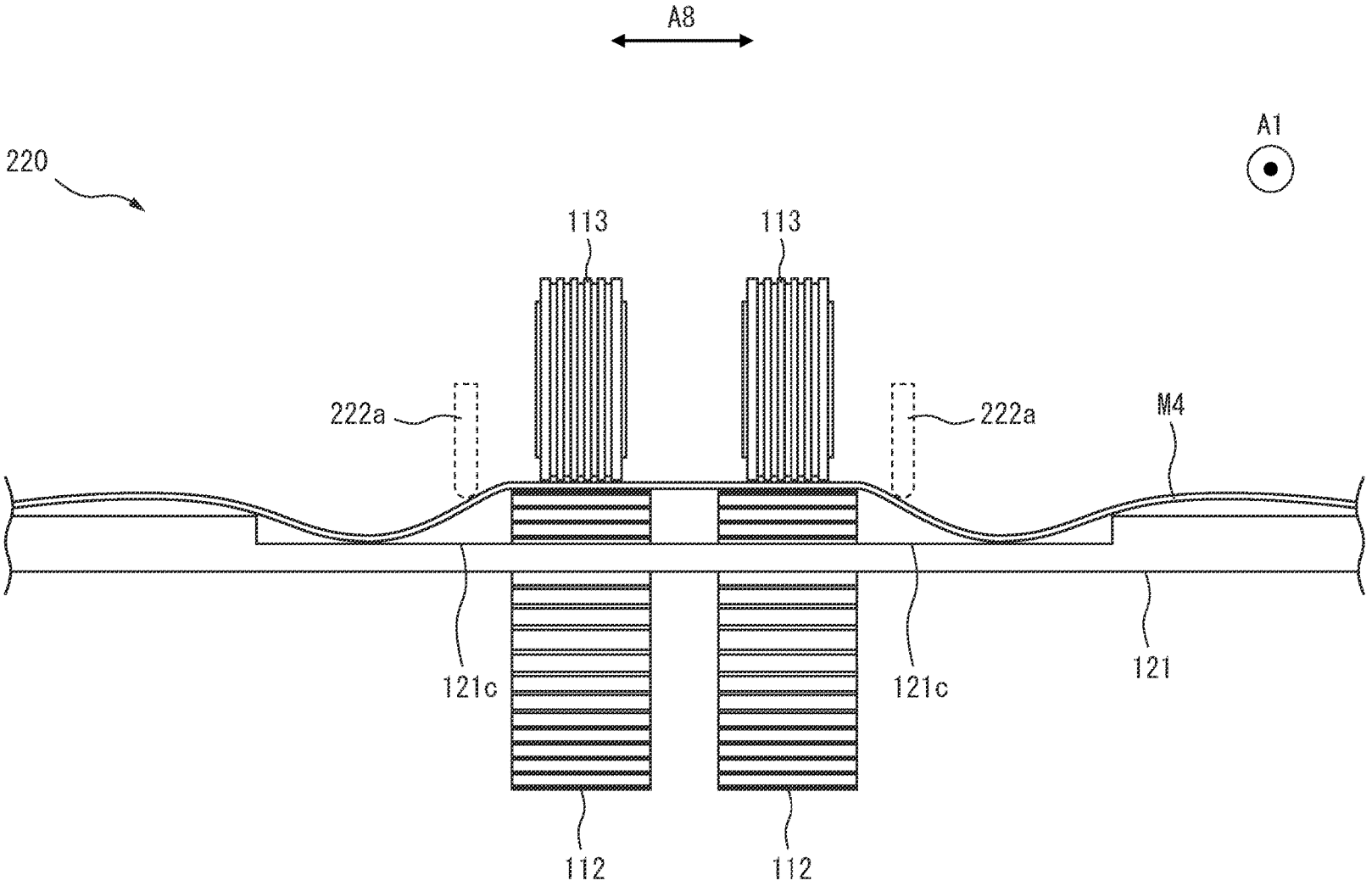
FIG. 18 is a schematic diagram for illustrating another example of protruding part.

FIG. 18 is a schematic diagram for illustrating an example of a protruding part in a medium conveying apparatus according to another embodiment FIG. 18 is a schematic diagram of an example of a feeding mechanism viewed from the downstream side. In FIG. 18, parts other than the protruding part 222*a* of a feed arm is omitted for enhanced visual recognizability.

As illustrated in FIG. 18, the medium conveying apparatus according to the present embodiment includes the feeding mechanism 220 in place of the feeding mechanism 120, and the feeding mechanism 220 includes the protruding part 222*a* in place of the protruding part 122*a*. The protruding part 222*a* has a structure similar to that of the protruding part 122*a*.

The tip (lower end) of the protruding part 222*a* has a rounded shape. In other words, a contact surface of the protruding part 222*a* coming in contact with a medium fed by a feed roller 112 is R-shaped. Consequently, when non-carbon paper is fed as a medium M4, the medium conveying apparatus can suppress color development due to the non-carbon paper coming in contact with the tip of the protruding part 222*a*. Furthermore, for example, when an envelope or thick paper is fed as a medium, the medium conveying apparatus can suppress appearing a vertical line on the medium by the tip of the protruding part 222*a*.

As described in detail above, the medium conveying apparatus can suitably feed a plurality of types of media when the R-shaped protruding part 222*a* is used as well.

Figure 19A:
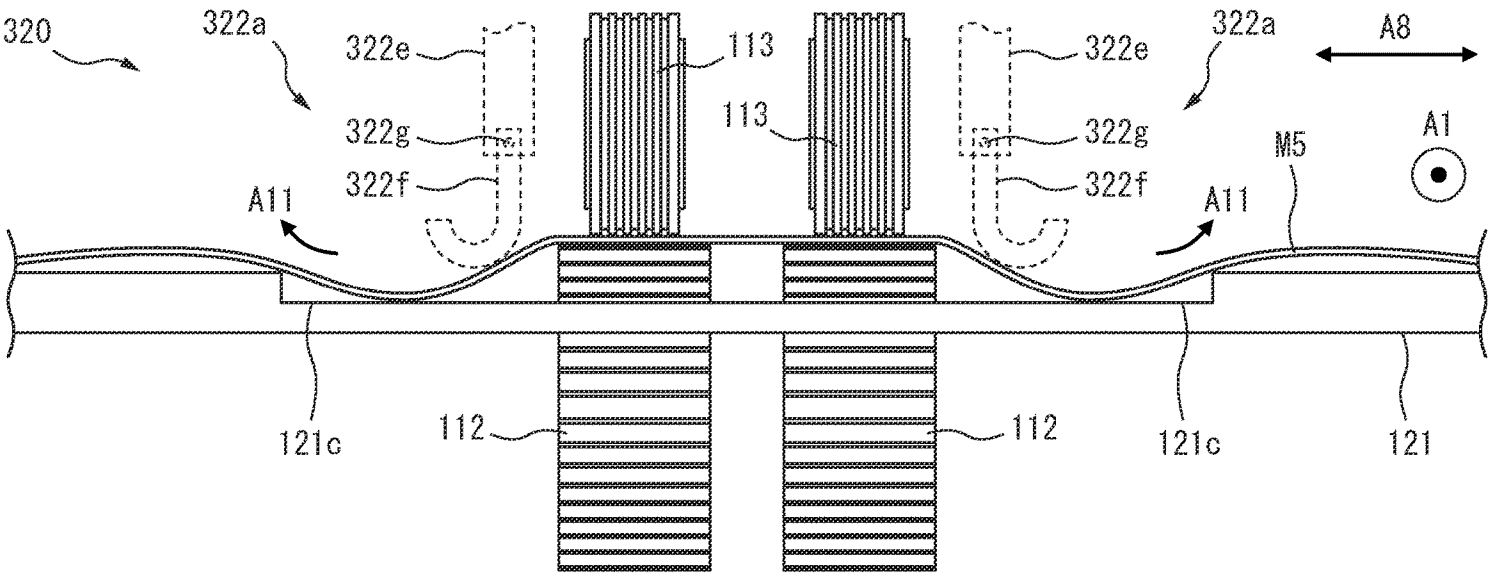
FIG. 19A is a schematic diagram for illustrating yet another example of protruding part.
Figure 19B:
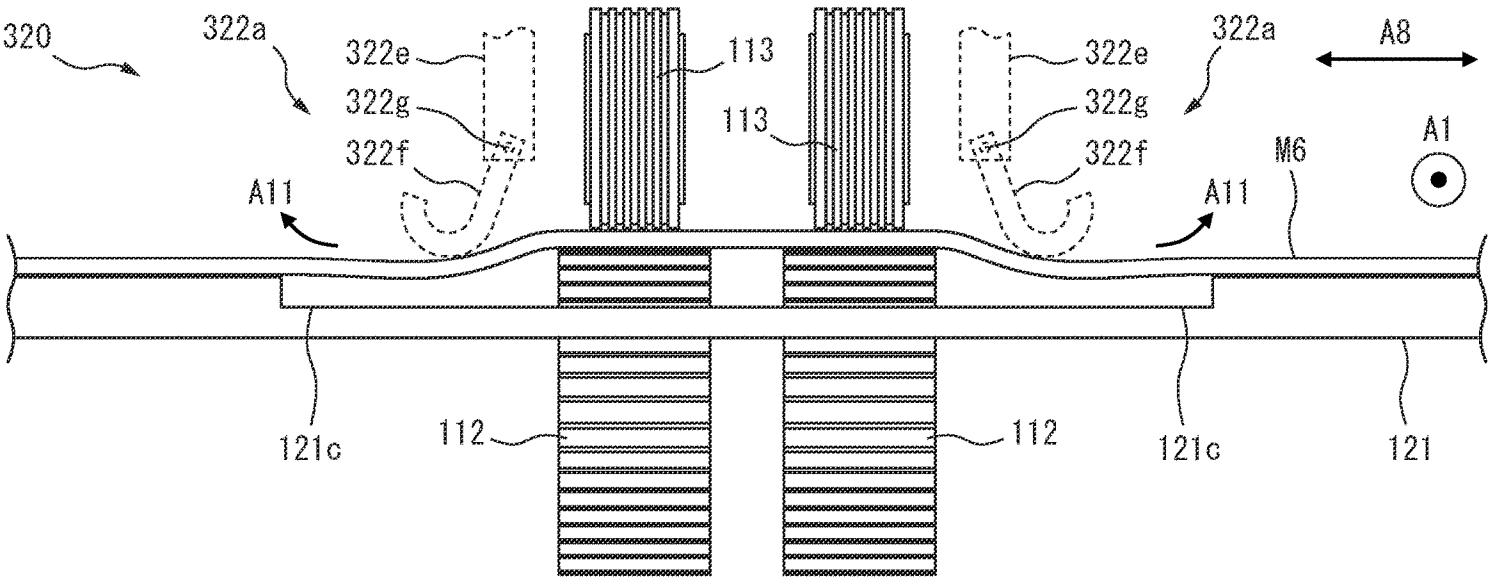
FIG. 19B is a schematic diagram for illustrating yet another example of protruding part.

FIG. 19A and FIG. 19B are schematic diagrams for illustrating an example of a protruding part in a medium conveying apparatus according to yet another embodiment FIG. 19A and FIG. 19B are schematic diagrams of a feeding mechanism viewed from the downstream side. In FIG. 19A and FIG. 19B, parts other than the protruding part 322*a* of a feed arm is omitted for enhanced visual recognizability. FIG. 19A illustrates a situation in which a medium M5 with low stiffness, such as thin paper or carbon paper, is fed, and FIG. 19B illustrates a situation in which a medium M6 with high stiffness, such as thick paper, is fed.

As illustrated in FIG. 19A and FIG. 19B, the medium conveying apparatus according to the present embodiment includes the feeding mechanism 320 in place of the feeding mechanism 120, and the feeding mechanism 320 includes the protruding part 322*a* in place of the protruding part 122*a*. The protruding part 322*a* has a structure similar to that of the protruding part 122*a*.

The protruding part 322*a* includes a fixed part 322*e* and a movable part 322*f*. For example, the fixed part 322*e* and the movable part 322*f* are formed of a stiff substance, such as metal. The fixed part 322*e* is fixed to the feed arm. The movable part 322*f* is supported by the fixed part 322*e* through an elastic member 322*g* in such a way as to be able to swing outward in a width direction A8 (in a direction of an arrow A11) For example, the elastic member 322*g* is a helical torsion coil spring and provides a force towards the inward side in the width direction A8 (in a direction opposite to the arrow A11) to the movable part 322*f* in such a way that the movable part 322*f* stops at a position almost perpendicular to a conveyance surface 121*a* (a placement position in FIG. 19A) by an unillustrated stopper.

As illustrated in FIG. 19A, when stiffness of the fed medium M5 is low, the medium M5 is bent by the protruding part 322*a*. Accordingly, the medium conveying apparatus 100 can stiffen the medium M5 with low stiffness and can improve stiffness of the medium M5 traveling in a medium conveying direction A1. On the other hand, as illustrated in FIG. 19B, when stiffness of the fed medium M6 is high, the protruding part 322*a* swings outward (in the direction of the arrow A11) in the width direction A8 by the medium M6. Accordingly, the medium conveying apparatus 100 can suppress damage to the medium M6 due to deformation of the medium M6 with high stiffness by the protruding part 322*a*. With regard to the medium M6 with high stiffness, the possibility of occurrence of buckling and jamming of a medium is sufficiently low even without stiffening by the protruding part 322*a*.

Thus, the protruding part 322*a* has elasticity as a whole. Consequently, the medium conveying apparatus can suppress occurrence of damage to a medium with high stiffness while suppressing occurrence of jamming of a medium with low stiffness.

The protruding part 322*a* may be integrally formed of a flexible substance, such as a rubber or a resin. In that case, the protruding part 322*a* has elasticity as one body. In that case, the medium conveying apparatus can suppress occurrence of damage to a medium with high stiffness while suppressing occurrence of jamming of a medium with low stiffness as well. Further, by the protruding part 322*a* being formed as one body, the medium conveying apparatus can reduce the apparatus cost and the apparatus weight.

As described in detail above, the medium conveying apparatus can suitably feed a plurality of types of media when the protruding part 322*a* with elasticity is used as well.

Figure 20A:
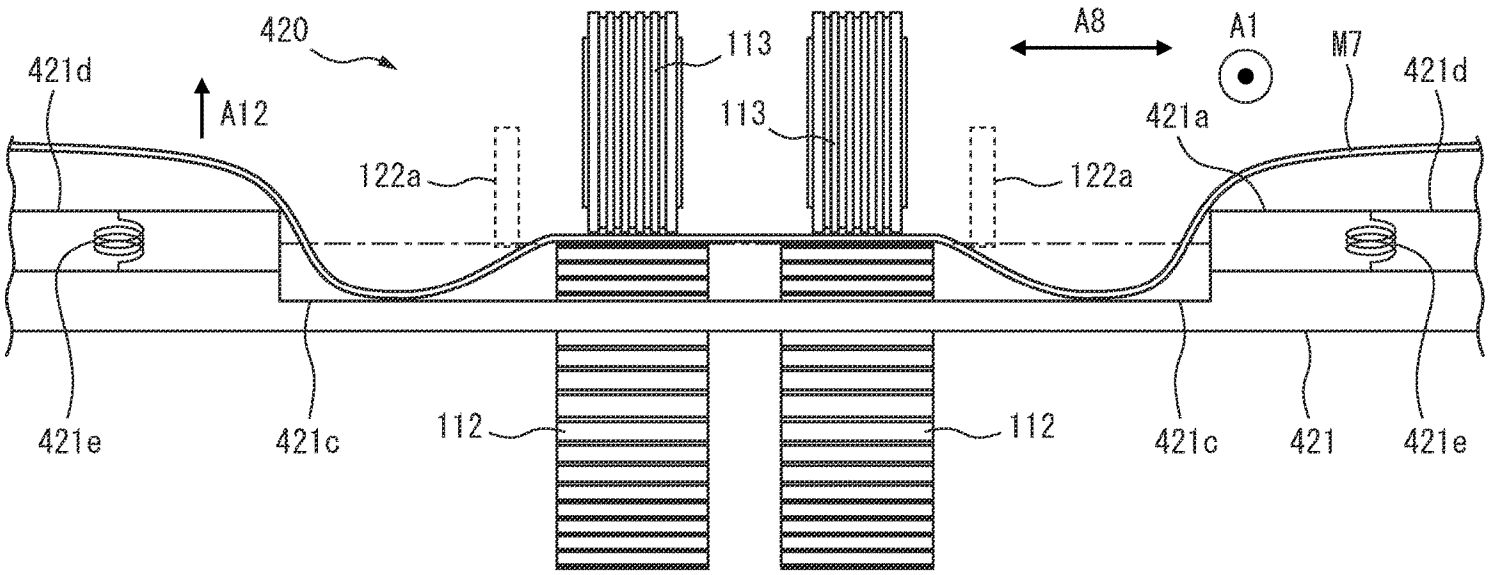
FIG. 20A is a schematic diagram for illustrating another example of guide member.
Figure 20B:
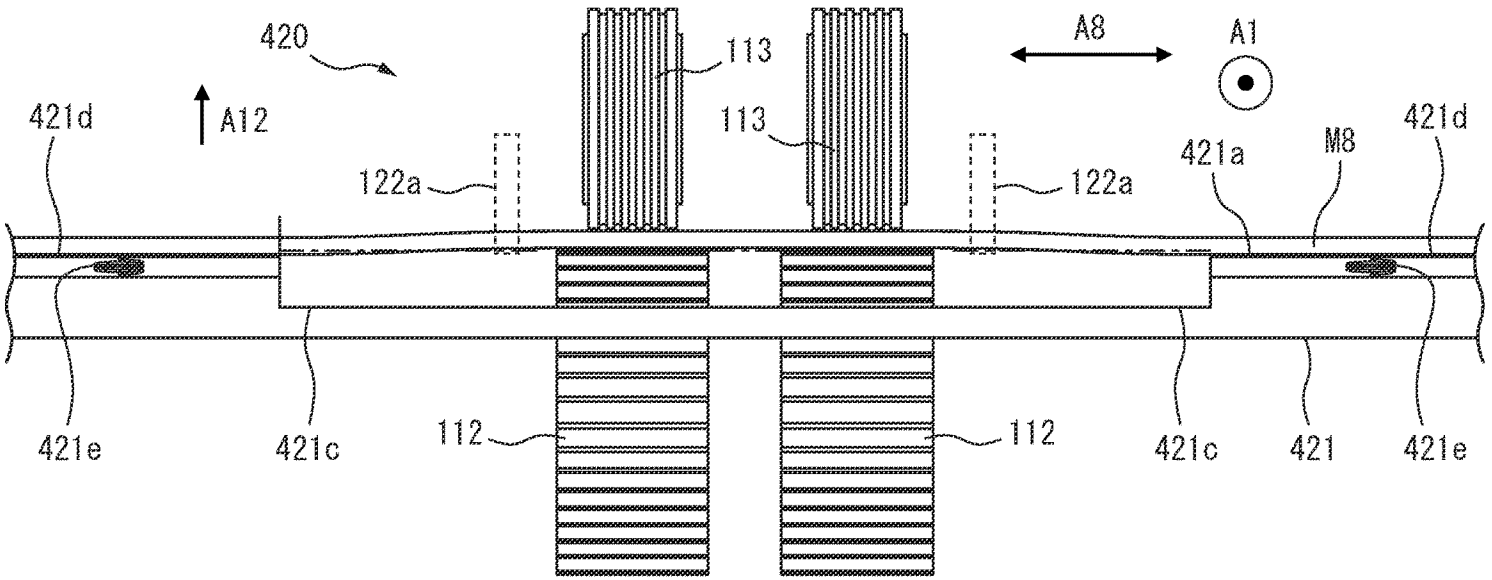
FIG. 20B is a schematic diagram for illustrating another example of guide member.

FIG. 20A and FIG. 20B are schematic diagrams for illustrating an example of a guide member in a medium conveying apparatus according to yet another embodiment. FIG. 20A and FIG. 20B are schematic diagrams of an example of a feeding mechanism viewed from the downstream side. In FIG. 20A and FIG. 20B, parts other than a protruding part 122*a* of a feed arm 122 is omitted for enhanced visual recognizability. FIG. 20A illustrates a situation in which a light medium M7, such as thin paper or carbon paper, is fed, and FIG. 20B illustrates a situation in which a heavy medium M8, such as thick paper, is fed.

As illustrated in FIG. 20A and FIG. 20B, the medium conveying apparatus according to the present embodiment includes the feeding mechanism 420 in place of the feeding mechanism 120, and the feeding mechanism 420 includes the guide member 421 in place of the guide member 121. The guide member 421 has a structure similar to that of the guide member 121.

The guide member 421 includes moving parts 421*d* located, in a width direction A8 perpendicular to a medium conveying direction A1, outside recessed parts 421*c* positioned on the left and right sides of a feed roller 112 relative to the medium conveying direction. An elastic member 421*e* is provided between the moving part 421*d* and the base of the guide member 421. For example, the elastic member 421*e* is a helical compression spring or a rubber and provides an upward force (in a direction of an arrow A12) to the moving part 421*d*. The moving part 421*d* pushes back the elastic member 421*e* and moves downward by the weight of a medium existing on the moving part 421*d*. In other words, the moving part 421*d* is provided in such a way as to be movable in a direction perpendicular to a conveyance surface 421*a* according to the weight of the fed medium.

Consequently, when the low-weight medium M7, such as thin paper, is fed, the placement position of the moving part 421*d* rises, and the level difference between the top surface of the moving part 421*d* and the recessed part 421*c* sufficiently increases. Therefore, the medium conveying apparatus can sufficiently stiffen the medium M7. On the other hand, when the heavy-weight medium M8, such as thick paper, is fed, the placement position of the moving part 421*d* lowers, and the level difference between the top surface of the moving part 421*d* and the recessed part 421*c* sufficiently decreases. Therefore, the medium conveying apparatus can suppress occurrence of damage to the medium M8 due to deformation of the medium M8 by the recessed part 421*c*.

As illustrated in FIG. 20A, when the elastic member 421*e* is not compressed, the moving part 421*d* is located at a first position (the placement position illustrated in FIG. 20A) higher than the top surface of the feed roller 112. Consequently, when the light-weight medium M7, such as thin paper, is fed, the level difference between the top surface of the moving part 421*d* and the recessed part 421*c* sufficiently increases, and therefore the medium conveying apparatus can sufficiently stiffen the medium M7.

On the other hand, as illustrated in FIG. 20B, when the elastic member 421*e* is compressed to the maximum, the moving part 421*d* is located at a second position (the placement position illustrated in FIG. 20B) lower than the top surface of the feed roller 112. Consequently, when the heavy-weight medium M8, such as thick paper, is fed, the feed roller 112 protrudes relative to the top surface of the moving part 421*d*, and therefore the medium conveying apparatus can provide a sufficient conveyance force to the medium M8 and satisfactorily feed the medium M8.

Thus, the moving part 421*d* is provided in such a way as to be movable between the first position higher than the top surface of the feed roller 112 and the second position lower than the top surface of the feed roller 112 in a direction A12 perpendicular to the conveyance surface 421*a*.

As described in detail above, the medium conveying apparatus can suitably feed a plurality of types of media when the guide member 421 is provided in a movable manner as well.

Figure 21B:
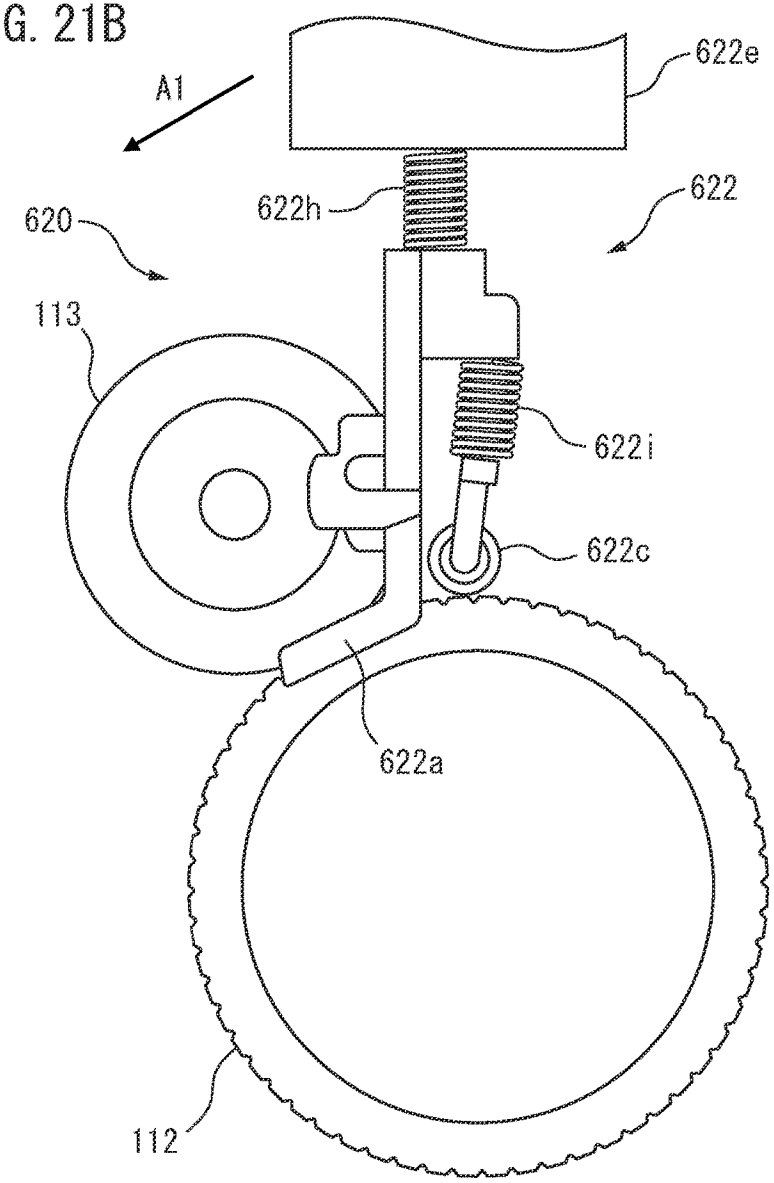
FIG. 21B is a schematic diagram for illustrating yet another example of feed arm.
Figure 21A:
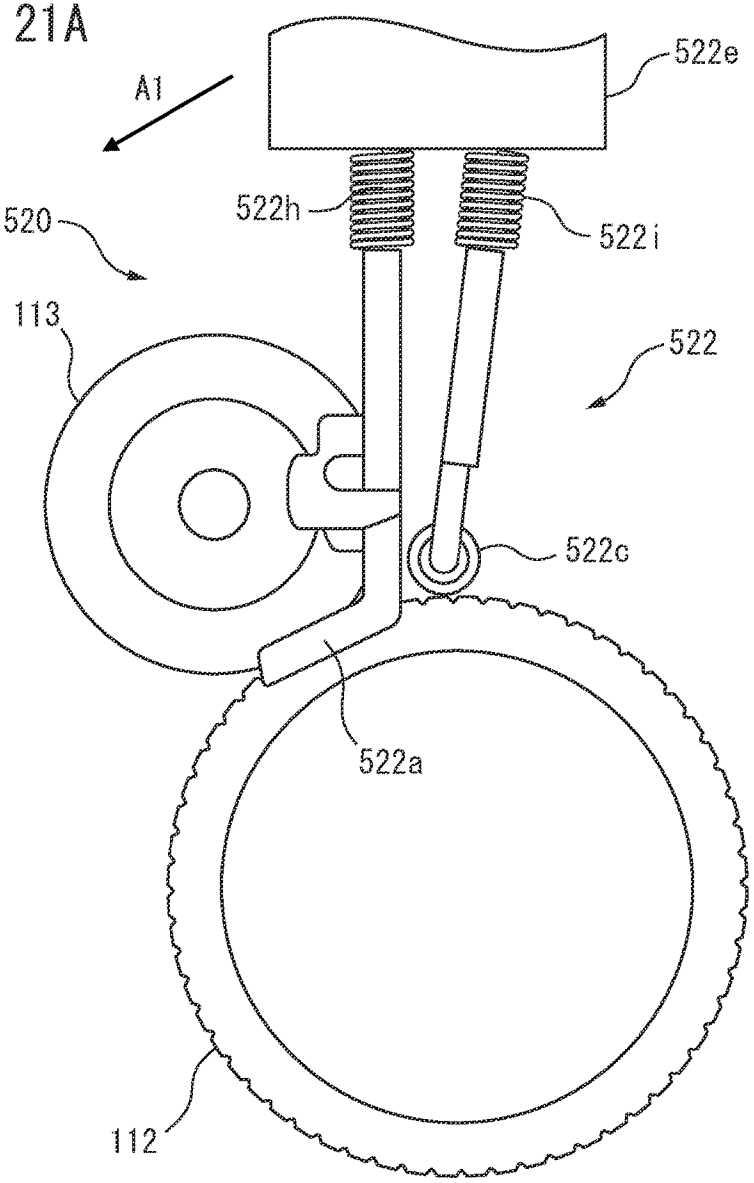
FIG. 21A is a schematic diagram for illustrating another example of feed arm.

FIG. 21A is a schematic diagram for illustrating an example of a feed arm in a medium conveying apparatus according to yet another embodiment.

As illustrated in FIG. 21A, the medium conveying apparatus according to the present embodiment includes a feeding mechanism 520 in place of the feeding mechanism 120, and the feeding mechanism 520 includes a feed arm 522 in place of the feed arm 122. The feed arm 522 has a structure similar to that of the feed arm 122.

The feed arm 522 includes a protruding part 522*a*, a press roller 522*c*, and a base 522*e*. The base 522*e* is provided with fixed to an upper housing 102. The protruding part 522*a* and the press roller 522*c* have structures similar to those of the protruding part 122*a* and the press roller 122*c* that are included in the feed arm 122, respectively. The protruding part 522*a* is supported by the base 522*e* through a first elastic member 522*h*. For example, the first elastic member 522*h* is a helical compression spring or a rubber and provides a downward force to the protruding part 522*a*. The press roller 522*c* is supported by the base 522*e* through a second elastic member 522*i*. For example, the second elastic member 522*i* is a helical compression spring or a rubber and provides a downward force to the press roller 522*c*.

Thus, the press roller 522*c* is supported by the base 522*e* through the second elastic member 522*i* separate from the first elastic member 522*h* provided between the base 522*e* and the protruding part 522*a*. Consequently, the press roller 522*c* is provided to move independently of the protruding part 522*a*.

In order to satisfactorily convey a medium with high stiffness, such as thick paper, a conveyance force greater than that for conveying a medium with low stiffness is generally required. In a case of the press roller moving in conjunction with the protruding part, when a medium with high stiffness is conveyed, the protruding part is pushed up by the medium and the press roller consequently rises (lifts), which reduces the force pressing the medium and reduces the conveyance force. On the other hand, even when the protruding part 522*a* is pushed up by a medium with high stiffness in a case of the press roller 522*c* moving independently of the protruding part 522*a*, the press roller 522*c* does not rise and continues to press the medium. Accordingly, the medium conveying apparatus can satisfactorily convey a medium with high stiffness, such as thick paper, while suppressing occurrence of jamming of a medium with low stiffness, such as thin paper.

As illustrated in FIG. 21A, the protruding part 522*a* may be provided on the downstream side of the press roller 522*c* in a medium conveying direction A1. In a case of the press roller moving in conjunction with the protruding part, when a thin medium is conveyed subsequently to conveyance of a thick medium, such as thick paper, the protruding part is pushed up by the rear edge of the preceding medium, and the press roller may consequently rise and may separate from the front edge of the succeeding medium. On the other hand, even when the protruding part 522*a* is pushed up by the preceding medium in a case of the press roller 522*c* moving independently of the protruding part 522*a*, the press roller 522*c* does not rise and continues to press the succeeding medium. Accordingly, even when a plurality of media with different thicknesses are successively fed, the medium conveying apparatus can satisfactorily feed each medium.

As described in detail above, the medium conveying apparatus can suitably feed a plurality of types of media when the press roller 522*c* is provided to move independently of the protruding part 522*a* as well.

FIG. 21B is a schematic diagram for illustrating an example of a feed arm 622 in a medium conveying apparatus according to yet another embodiment.

As illustrated in FIG. 21B, the medium conveying apparatus according to the present embodiment includes a feeding mechanism 620 in place of the feeding mechanism 520, and the feeding mechanism 620 includes the feed arm 622 in place of the feed arm 522. The feed arm 622 has a structure similar to that of the feed arm 522.

The feed arm 622 includes a protruding part 622*a*, a press roller 622*c*, and a base 622*e*. The base 622*e* is provided with fixed to an upper housing 102. The protruding part 622*a*, the press roller 622*c*, and the base 622*e* have structures similar to those of the protruding part 522*a*, the press roller 522*c*, and the base 522*e* that are included in the feed arm 522, respectively. The protruding part 622*a* is supported by the base 622*e* through a first elastic member 622*h*. For example, the first elastic member 622*h* is a helical compression spring or a rubber and provides a downward force to the protruding part 622*a*. The press roller 622*c* is supported by a member including the protruding part 622*a* through a second elastic member 622*i*. For example, the second elastic member 622*i* is a helical compression spring or a rubber and provides a downward force to the press roller 622*c*.

The press roller 622*c* is provided to move independently of the protruding part 622*a* in this case as well. Accordingly, the medium conveying apparatus can satisfactorily convey a medium with high stiffness, such as thick paper, while suppressing occurrence of jamming of a medium with low stiffness, such as thin paper. Further, even when a plurality of media with different thicknesses are successively fed, the medium conveying apparatus can satisfactorily convey each medium.

As described in detail above, the medium conveying apparatus can suitably feed a plurality of types of media when the press roller 622*c* is provided to move independently of the protruding part 622*a* as well.

The feed arm 522 or the feed arm 622 may further include a second protruding part similar to the second protruding part 122*d*. In that case, the second protruding part is provided to move in conjunction with the protruding part 522*a* or the protruding part 622*a* and move independently of the press roller 522*c* or the press roller 622*c*.

Figure 22:
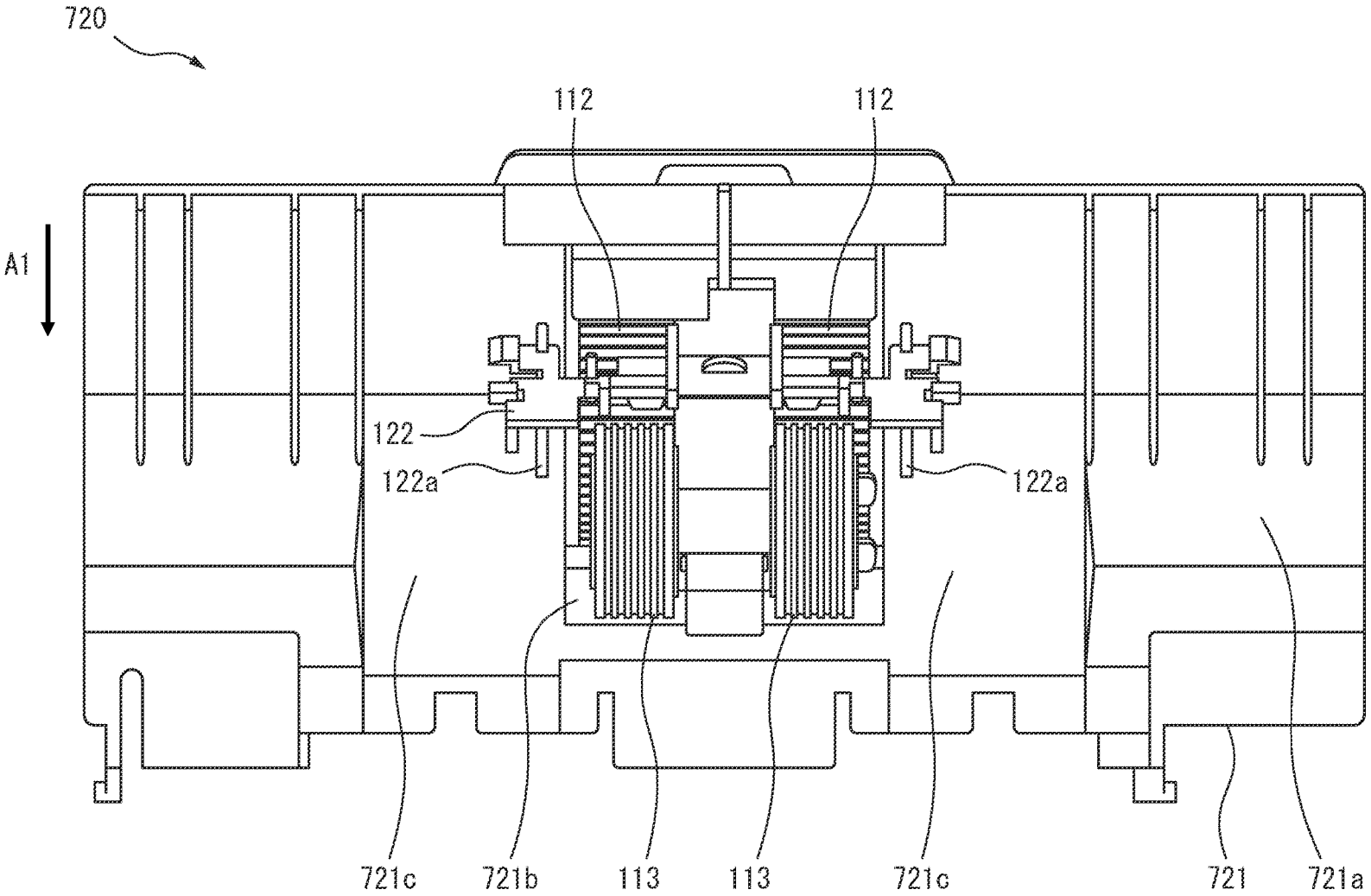
FIG. 22 is a schematic diagram for illustrating yet another example of guide member.

FIG. 22 is a schematic diagram for illustrating an example of a guide member in a medium conveying apparatus according to yet another embodiment.

As illustrated in FIG. 22, the medium conveying apparatus according to the present embodiment includes a feeding mechanism 720 in place of the feeding mechanism 120, and the feeding mechanism 720 includes the guide member 721 in place of the guide member 121. The guide member 721 has a structure similar to that of the guide member 121. The guide member 721 includes an opening 721*b* similar to the opening 121*b*, and a conveyance surface 721*a* of the guide member 721 includes a recessed part 721*c* similar to the recessed part 121*c*.

The opening 721*b* is smaller than the opening 121*b*, and the recessed part 721*c* exists up to the neighborhood of a feed roller 112 in a width direction A8. Therefore, the protruding part 122*a* is located at a position facing the recessed part 721*c*.

As described in detail above, the medium conveying apparatus can suitably feed a plurality of types of media when the protruding part 122*a* is located at a position facing the recessed part 721*c* as well.

Figure 23:
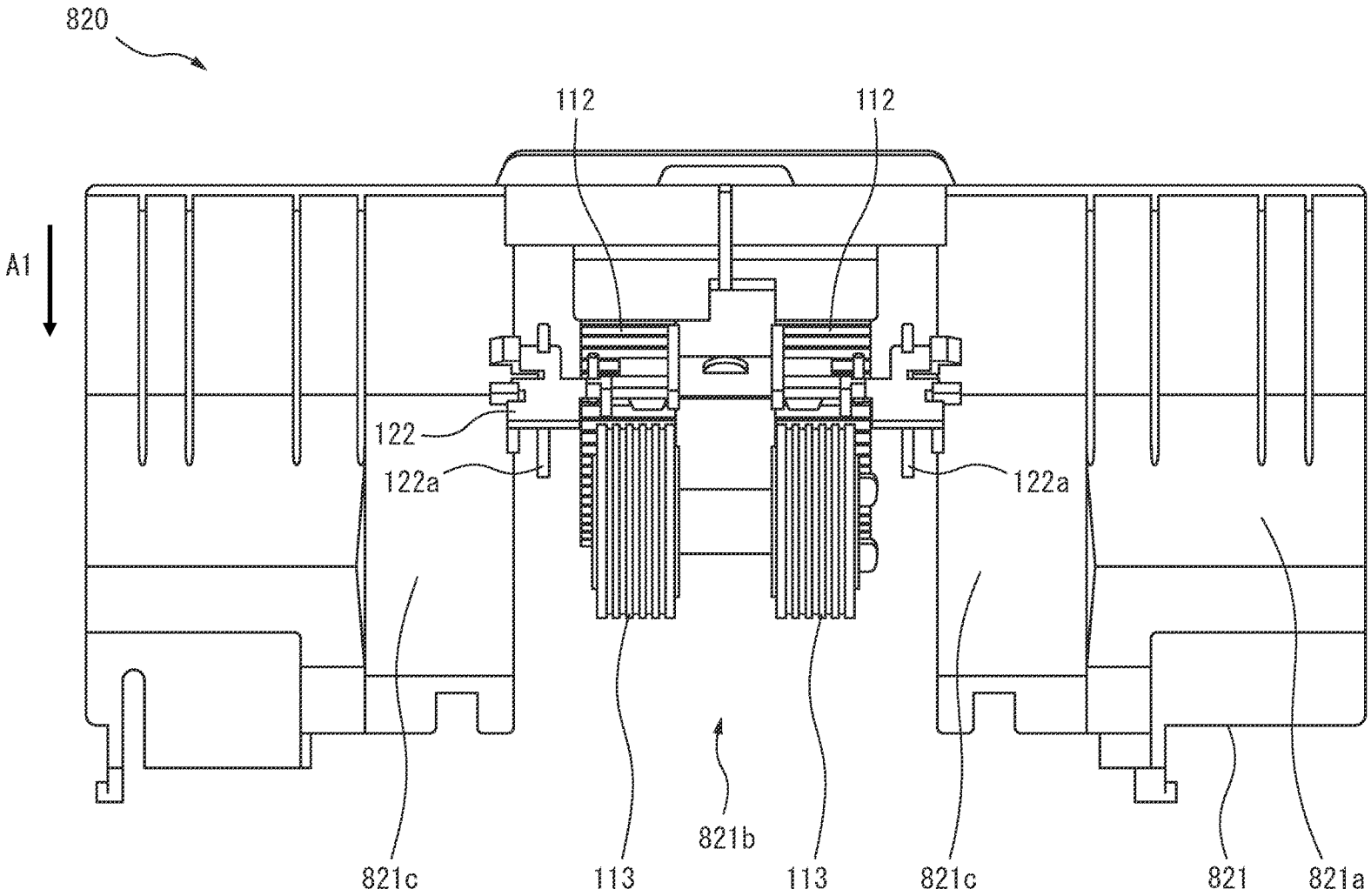
FIG. 23 is a schematic diagram for illustrating yet another example of guide member.

FIG. 23 is a schematic diagram for illustrating an example of a guide member in a medium conveying apparatus according to yet another embodiment.

As illustrated in FIG. 23, the medium conveying apparatus according to the present embodiment includes a feeding mechanism 820 in place of the feeding mechanism 120, and the feeding mechanism 820 includes the guide member 821 in place of the guide member 121. The guide member 821 has a structure similar to that of the guide member 121. A conveyance surface 821*a* of the guide member 821 has a recessed part 821*c* similar to the recessed part 121*c*.

The guide member 821 does not include the opening 121*b* and instead includes a notch 821*b*. A feed roller 112 is located inside the notch 821*b*, and the protruding part 122*a* is located at a position facing the notch 821*b*.

As described in detail above, the medium conveying apparatus can suitably feed a plurality of types of media when the guide member 821 includes the notch 821*b* as well.

Figure 24:
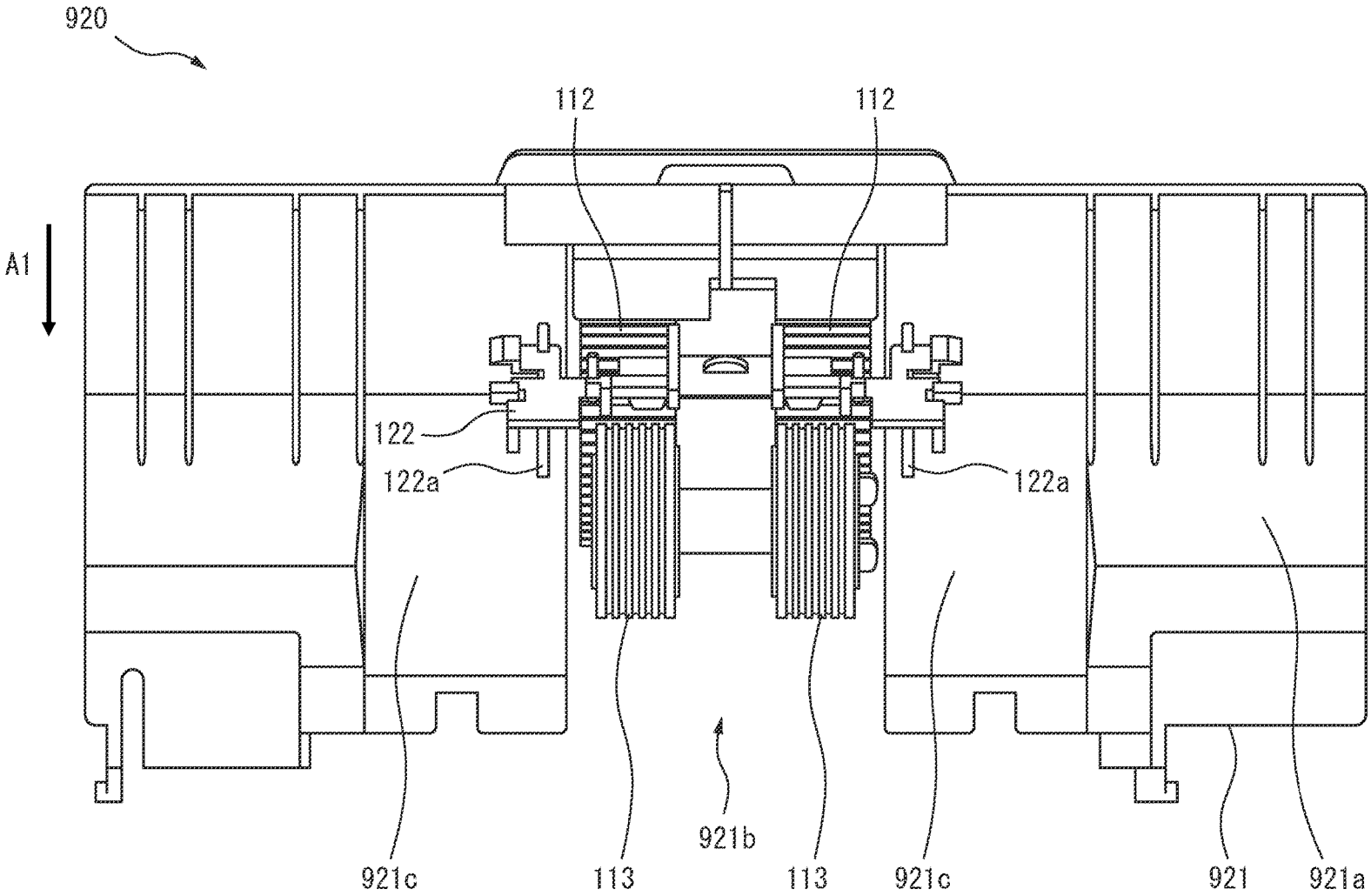
FIG. 24 is a schematic diagram for illustrating yet another example of guide member.

FIG. 24 is a schematic diagram for illustrating an example of a guide member 921 in a medium conveying apparatus according to yet another embodiment.

As illustrated in FIG. 24, the medium conveying apparatus according to the present embodiment includes a feeding mechanism 920 in place of the feeding mechanism 820, and the feeding mechanism 920 includes the guide member 921 in place of the guide member 821. The guide member 921 has a structure similar to that of the guide member 821. The guide member 921 includes a notch 921*b* similar to the notch 821*b*, and a conveyance surface 921*a* of the guide member 921 includes a recessed part 921*c* similar to the recessed part 821*c*.

The notch 921*b* is smaller than the notch 821, and the recessed part 921*c* exists up to the neighborhood of a feed roller 112 in a width direction A8. Therefore, the protruding part 122*a* is located at a position facing the recessed part 921*c*.

As described in detail above, the medium conveying apparatus can suitably feed a plurality of types of media when the guide member 921 includes the notch 921*b* and the protruding part 122*a* is located at a position facing the recessed part 921*c* as well.

Figure 25:
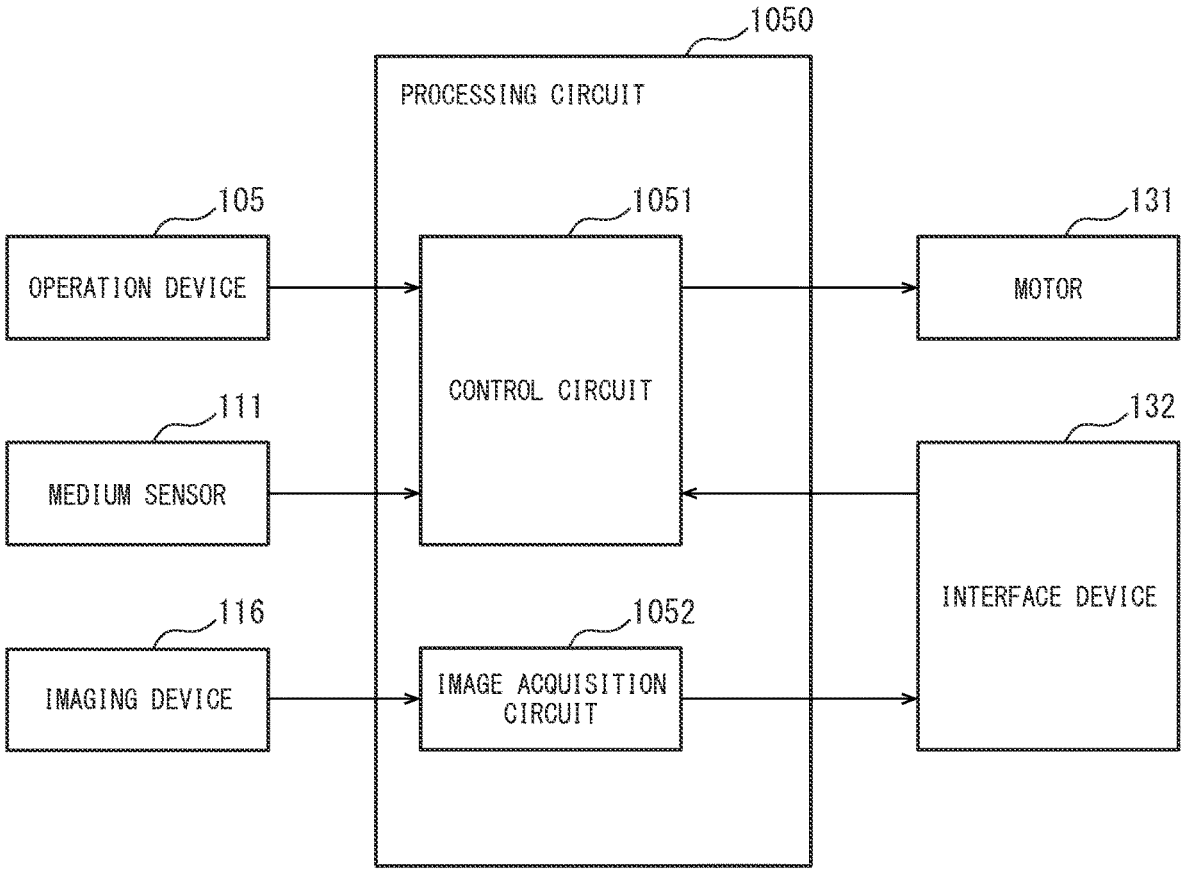
FIG. 25 is a diagram illustrating a schematic configuration of another example of processing circuit.

FIG. 25 is a diagram illustrating a schematic configuration of an example of a processing circuit in a medium conveying apparatus according to yet another embodiment. The processing circuit 1050 is used in place of the processing circuit 150 in the medium conveying apparatus 100 and executes the medium reading processing, etc., in place of the processing circuit 150. The processing circuit 1050 includes a control circuit 1051 and an image acquisition circuit 1052, etc. Each component may be independently configured with an integrated circuit, a microprocessor, firmware, etc.

The control circuit 1051 is an example of a control module and has a function similar to that of the control module 151. The control circuit 1051 receives the operation signal from an operation device 105 or an interface device 132, the medium signal from the medium sensor 111. The control circuit 1051 controls a motor 131, based on the received information.

The image acquisition circuit 1052 is an example of an image acquisition module and has a function similar to that of the image acquisition module 152. The image acquisition circuit 1052 acquires the input image from an imaging device 116 and outputs the image to the interface device 132.

As described in detail above, the medium conveying apparatus can suitably feed a plurality of types of media when the processing circuit 1050 is used as well.

REFERENCE SIGNS LIST

100 Medium conveying apparatus, 103 Loading tray, 112 Feed roller, 113 Separation roller, 121, 421 Guide member, 121*a* Conveyance surface, 121*b* Opening, 121*c*, 421*c* Recessed part, 121*b*, 721*b* Opening, 122, 522, 622 Feed arm, 122*a*, 222*a*, 322*a*, 522*a*, 622*a* Protruding part, 122*b* Contact surface, 122*c*, 522*c*, 622*c* Press roller, 122*d* Second protruding part, 124 Setting guide, 421*d* Moving part, 821*b*, 921*b* Notch

The invention claimed is:

1. A medium conveying apparatus comprising:

a feed roller to feed a medium;

a separation roller located to face the feed roller and to form a nip part with the feed roller for separating the medium;

a press roller facing the feed roller and located on an upstream side of the nip part formed by the feed roller and the separation roller in a medium conveying direction to press the medium fed by the feed roller toward the feed roller;

protruding parts located on left and right sides of the separation roller relative to the medium conveying direction, and configured to move in conjunction with the press roller, wherein a portion of at least one of the protruding parts is positioned on the feed roller side of the nip part, and when viewed from a direction perpendicular to the medium conveying direction, at least a portion of at least one of the protruding parts continuously overlaps with the nip part throughout feeding of the medium.

2. The medium conveying apparatus according to claim 1, further comprising:

a loading tray; and a guide member, which is located at a first position where contact between the medium placed in the loading tray, and the feed roller and the press roller is restricted before medium feeding, and is located at a second position where contact between the medium placed in the loading tray, and the feed roller and the press roller is allowed at a time of medium feeding, wherein the press roller is configured to come in contact with the medium placed in the loading tray before the feed roller comes in contact with the medium when an amount of medium placed in the loading tray is greater than or equal to a predetermined amount, and come in contact with the medium placed in the loading tray after the feed roller comes in contact with the medium when the amount of medium placed in the loading tray is less than the predetermined amount, at a time when the guide member moves from the first position to the second position.

3. The medium conveying apparatus according to claim 1, further comprising second protruding parts facing the feed roller, located on an upstream side of the nip part in the medium conveying direction, and configured to guide the medium fed by the feed roller to the nip part.

4. The medium conveying apparatus according to claim 1, further comprising a guide member including an opening, notch, or a recessed part and configured to form a conveyance surface of the medium, wherein a contact surface of at least one of the protruding parts coming in contact with the medium fed by the feed roller is formed in such a way as to be in parallel with a region of the conveyance surface on an upstream side of the opening, the notch, or the recessed part in the medium conveying direction.

5. The medium conveying apparatus according to claim 1, wherein a contact surface of at least one of the protruding parts coming in contact with the medium fed by the feed roller is R-shaped.

6. The medium conveying apparatus according to claim 1, wherein the protruding parts have elasticity.

7. The medium conveying apparatus according to claim 1, further comprising a guide member including an opening, notch, or a recessed part and configured to form a conveyance surface of the medium, wherein the guide member further includes a moving part located outside the opening, the notch, or the recessed part in a direction perpendicular to the medium conveying direction and provided in such a way as to be movable in a direction perpendicular to the conveyance surface according to a weight of the fed medium.

8. The medium conveying apparatus according to claim 7, wherein the moving part is provided in such a way as to be movable between a first position higher than a top surface of the feed roller and a second position lower than the top surface of the feed roller in a direction perpendicular to the conveyance surface.

9. The medium conveying apparatus according to claim 1, further comprising a guide member including an opening, notch, or a recessed part and configured to form a conveyance surface of the medium, wherein the protruding parts are located at the positions facing the opening or the notch, or the recessed part in such a way that the medium is conveyed between the protruding parts and the opening or the notch, or the recessed part.

10. The medium conveying apparatus according to claim 1, further comprising:

a flap;

a guide member movable between a first position and a second position; and a loading tray for placing the medium to be fed by the feed roller; wherein the guide member restricts contact between the medium placed on the loading tray and the feed roller when located at the first position, and allows contact between the medium placed in the loading tray and the feed roller when located at the second position, and the flap is engaged with the guide member when the guide member is located at the first position to prevent the medium from entering the nip part.

11. The medium conveying apparatus according to claim 1, wherein the protruding parts are not swingable.

* * * * *